US009405236B2

(12) United States Patent
Ogushi et al.

(10) Patent No.: US 9,405,236 B2
(45) Date of Patent: Aug. 2, 2016

(54) IMAGE FORMING DEVICE

(71) Applicant: KONICA MINOLTA, INC., Chiyoda-ku, Tokyo (JP)

(72) Inventors: Takehiro Ogushi, Hachioji (JP); Shohei Yamazaki, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/737,828

(22) Filed: Jun. 12, 2015

(65) Prior Publication Data

US 2015/0362870 A1 Dec. 17, 2015

(30) Foreign Application Priority Data

Jun. 16, 2014 (JP) ..... 2014-123596

(51) Int. Cl.

| | |
|---|---|
| ***G03G 15/16*** | (2006.01) |
| ***G03G 15/20*** | (2006.01) |
| ***G03G 15/23*** | (2006.01) |
| ***G03G 15/00*** | (2006.01) |

(52) U.S. Cl.

CPC ..... *G03G 15/1665* (2013.01); *G03G 15/1675* (2013.01); *G03G 15/2039* (2013.01); *G03G 15/23* (2013.01); *G03G 15/5029* (2013.01); *G03G 15/6576* (2013.01); *G03G 2215/00662* (2013.01); *G03G 2215/00772* (2013.01); *G03G 2215/00776* (2013.01)

(58) Field of Classification Search

CPC ..... G03G 15/1665; G03G 15/2039; G03G 15/1645; G03G 15/1675; G03G 15/6576

USPC ..... 399/66, 69, 341, 406

See application file for complete search history.

(56) References Cited

U.S. PATENT DOCUMENTS

| | | | | |
|---|---|---|---|---|
| 5,905,925 | A * | 5/1999 | Kawabata et al. | G03G 15/5029 399/66 |
| 6,223,004 | B1 * | 4/2001 | Kodama | G03G 15/1675 399/66 |
| 7,460,824 | B2 * | 12/2008 | Nakajima et al. | G03G 15/6576 399/341 |

(Continued)

FOREIGN PATENT DOCUMENTS

| | | | |
|---|---|---|---|
| EP | 2624058 | A1 | 8/2013 |
| JP | 2007259466 | A | 10/2007 |
| JP | 2012118496 | A | 6/2012 |

OTHER PUBLICATIONS

Extended European Search Report dated Nov. 9, 2015, issued in counterpart European Application No. 15172059.6.

*Primary Examiner* — William J Royer

(74) *Attorney, Agent, or Firm* — Holtz, Holtz & Volek PC

(57) ABSTRACT

An image forming device capable of performing both-side printing, statically transferring, by application of a transfer voltage, an unfixed image formed on an image carrier to a recording sheet when passing through a transfer position, and then thermally fixing the unfixed image when the recording sheet passes through a fixing position where a heating rotating body is disposed. The image forming device acquires an index value of a water content at each of a plurality of sheet-passing-direction positions of the recording sheet having undergone thermal fixing of an unfixed image statically transferred onto a first side thereof, and controls, for each of the positions, a transfer voltage applied for statically transferring an unfixed image onto a second side of the recording sheet, so that the lower the water content indexed by the index value of the position, the greater an absolute value of the transfer voltage.

10 Claims, 19 Drawing Sheets

(56) References Cited

U.S. PATENT DOCUMENTS

| | | | | |
|---|---|---|---|---|
| 8,265,541 | B2 * | 9/2012 | Kougami | G03G 15/6576 399/406 |
| 2001/0002953 | A1 | 6/2001 | Sato | |
| 2009/0010667 | A1 | 1/2009 | Mabuchi et al. | |
| 2012/0114358 | A1 | 5/2012 | Sugiyama et al. | |
| 2012/0315060 | A1 | 12/2012 | Sugiyama et al. | |
| 2013/0195534 | A1 | 8/2013 | Oohara et al. | |

* cited by examiner

FIG. 4

| Sampling sheet position | Elapsed time | Fixing position temperature (T) |
|---|---|---|
| S0 | 0 | T0 |
| S1 | t | T1 |
| S2 | 2t | T2 |
| S3 | 3t | T3 |
| S4 | 4t | T4 |
| S5 | 5t | T5 |

| Sampling sheet position | Elapsed time | Fixing position temperature (T) | Applied transfer voltage (V) |
|---|---|---|---|
| S0 | 0 | T0 | V0 |
| S1 | t | T1 | V1 |
| S2 | 2t | T2 | V2 |
| S3 | 3t | T3 | V3 |
| S4 | 4t | T4 | V4 |
| S5 | 5t | T5 | V5 |

IMAGE FORMING DEVICE

CROSS-REFERENCE TO RELATED APPLICATION

This application is based on an application No. 2014-123596 filed in Japan, the contents of which are hereby incorporated by reference.

BACKGROUND OF THE INVENTION (1) Field of the Invention

The present disclosure pertains to an image forming device capable of both-side printing, such as a printer or a photocopier, executing a printing process by statically transferring an unfixed image onto a recording sheet and then thermally fixing the unfixed image onto the recording sheet. Particularly, the present disclosure pertains to a technology for controlling transfer voltage applied for the static transfer of the unfixed image during both-side printing.

(2) Description of the Related Art

An image forming device such as a printer, a photocopier, and the like is commonly provided with a both-side printing function of statically transferring an unfixed image to each of a first side (one side, e.g., a front side) of a recording sheet and a second side (the other side, e.g., a back side) of the recording sheet and then thermally fixing the unfixed images onto the recording sheet.

Also, a fixing temperature required for thermally fixing an unfixed image onto a recording sheet varies under different conditions, such as an amount of toner to be fixed onto the recording sheet, a type of image to be formed on the recording sheet, and the like. In order to prevent insufficient fixing under these different conditions, a target fixing temperature at which a surface temperature of a heating rotating body is to be maintained during thermal fixing with respect to a recording sheet page may be set to a temperature sufficient to ensure good fixing under printing conditions requiring the greatest amount of heat to be applied for the thermal fixing.

However, when the target fixing temperature is set as described above, more electricity than necessary is consumed particularly when thermally fixing an unfixed image on a page that does not require the greatest amount of heat, which is not desirable for energy conservation.

Technology for reducing the electricity consumption of thermal fixing has been proposed, such as Patent Literature 1 (Japanese Patent Application No. 2012-118496), which discloses changing the target fixing temperature at which the surface temperature of the heating rotating body is maintained during thermal fixing for each page, in accordance with the image content of the respective page. This enables adjusting the fixing temperature to an optimal temperature that is in accordance with the image content of a page that prevents the fixing temperature applied from becoming excessive or insufficient, which in turn reduces the electricity consumption required for thermal fixing.

As described above, the technology described by Patent Literature 1 varies the target fixing temperature between pages. Due to this, particularly when continuously printing two or more pages, the fixing temperature may change by a great amount while performing thermal fixing with respect to one page. In such circumstances, when the two or more pages are two sides of one recording sheet with respect to which both-side printing is performed, the amount of water contained (water content) in the recording sheet may vary in a sheet passing direction due to the change in fixing temperature occurring while thermal fixing is performed with respect to one side. As a result, electrical resistance in the sheet passing direction changes, which produces transfer unevenness when statically transferring an unfixed image onto the other side. This results in deterioration of image quality of the other side.

In consideration of the above-described problem, the present disclosure aims to provide an image forming device having a both-side printing function enabling, during both-side printing, prevention of transfer unevenness caused by change in water content in a recording sheet.

SUMMARY OF THE INVENTION

Problems to be Solved by the Invention

In order to solve the above-described problem, one aspect of the present disclosure is an image forming device capable of performing both-side printing with respect to a recording sheet, the image forming device statically transferring, by application of a transfer voltage, an unfixed image formed on an image carrier to the recording sheet when passing through a transfer position, and then thermally fixing the unfixed image onto the recording sheet when the recording sheet passes through a fixing position where a heating rotating body is disposed, the image forming device including: a water content index acquisition unit configured to acquire an index value of a water content at each of a plurality of sheet-passing-direction positions of the recording sheet having undergone thermal fixing of a first unfixed image statically transferred onto a first side thereof; and a transfer control unit configured to control, for each of the positions of the recording sheet, a transfer voltage applied for statically transferring a second unfixed image onto a second side of the recording sheet, so that the lower the water content indexed by the index value of the position, the greater an absolute value of the transfer voltage.

BRIEF DESCRIPTION OF THE DRAWINGS

These and the other objects, advantages and features of the disclosure will become apparent from the following description thereof taken in conjunction with the accompanying drawings which illustrate a specific embodiment of the disclosure.

In the drawings:

FIG. 4 is a table indicating the relationship between the sampling sheet positions illustrated in FIG. 3, elapsed time from when a leading edge of a recording sheet P illustrated in FIG. 3 reaches a fixing position, and fixing position temperatures pertaining to the sampling sheet positions;

DESCRIPTION OF THE PREFERRED EMBODIMENTS

A tandem image forming device (hereinafter simply termed an image forming device) is described below as an example of an embodiment of the image forming device pertaining to one aspect of the disclosure.

[1] Image Forming Device Configuration

Figure 1:
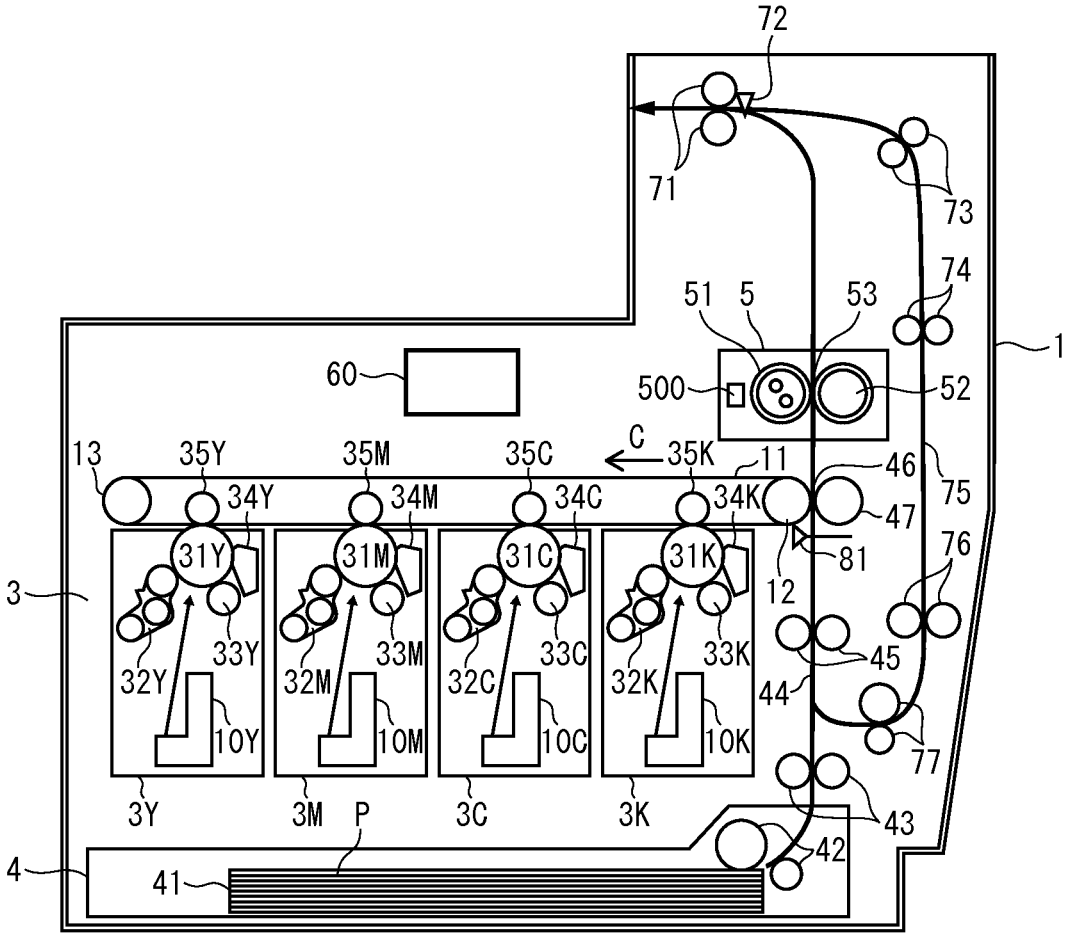
FIG. 1 depicts the configuration of an image forming device 1.

The configuration of an image forming device 1 pertaining to the present embodiment is described first. FIG. 1 depicts the configuration of the image forming device 1 pertaining to the present embodiment. As depicted in FIG. 1, the image forming device 1 includes an image processing unit 3, a feed unit 4, a fixing device 5, and a control unit 60.

The image forming device 1 is connected to a network (e.g., a LAN) and, upon receiving a print instruction from an external terminal device (not diagrammed) or an operation panel having a non-diagrammed display unit, forms a toner image in each of yellow, magenta, cyan, and black in accordance with the instruction and then forms a full color image by overlay transfer of the toner images onto a recording sheet, thus realizing a printing process onto the recording sheet. The reproduction colors yellow, magenta, cyan, and black are hereinafter represented by the initials Y, M, C, and K. The reference signs for components pertaining to the respective reproduction colors have the initials Y, M, C, and K appended thereto.

The image processing unit 3 includes imaging units 3Y, 3M, 3C, and 3K, an intermediate transfer belt 11, primary transfer rollers 35Y, 35M, 35C, and 35K, and a secondary transfer roller 47. The imaging units 3Y, 3M, 3C, and 3K are each configured similarly. As such, the configuration of imaging unit 3Y is described below as a representative example.

Imaging unit 3Y (3M, 3C, 3K) includes a photosensitive drum 31Y (31M, 31C, 31K), as well as a developing unit 32Y (32M, 32C, 32K), a charging unit 33Y (33M, 33C, 33K), a cleaner 34Y (34M, 34C, 34K) cleaning the photosensitive drum 31Y (31M, 31C, 31K), and an exposure unit 10Y (10M, 10C, 10K) disposed around the photosensitive drum 31Y (31M, 31C, 31K). A yellow Y toner image is created over the photosensitive drum 31Y. The developing unit 32Y (32M, 32C, 32K) faces the photosensitive drum 31Y (31M, 31C, 31K) and transports charged toner to the photosensitive drum 31Y (31M, 31C, 31K). The intermediate transfer belt 11 is an endless belt suspended across a driving roller 12 and a driven roller 13, and is driven to circulate in the direction indicated by arrow C. The exposure unit 10Y (10M, 10C, 10K) includes a light-emitting element such as a laser diode, emits a laser light for image formation in accordance with a drive signal from the control unit 60, and performs an exposure scan of the photosensitive drum 31Y (31M, 31C, 31K). The exposure scan forms a latent static image on the photosensitive drum 31Y (31M, 31C, 31K) that has been charged by the charging unit 33Y (33M, 33C, 33K). Imaging units 3M, 3C, and 3K also have latent static images similarly formed on the respective photosensitive drums 31M, 31C, and 31K.

The latent static images respectively formed on each of the photosensitive drums (i.e., photosensitive drums 31Y, 31M, 31C, and 31K) are developed by respective developing units (i.e., developing units 32Y, 32M, 32C, and 32K) of the imaging units 3Y, 3M, 3C, and 3K, thus forming toner images (i.e., unfixed images) in each corresponding color on the photosensitive drums 31Y, 31M, 31C, and 31K. The unfixed images thus formed sequentially undergo a primary transfer onto the intermediate transfer belt 11 with timing offset so that each unfixed image is transferred to the same overlapping position on the intermediate transfer belt 11 performed by respective primary transfer rollers (i.e., primary transfer rollers 35Y, 35M, 35C, and 35K) corresponding to the imaging units 3Y, 3M, 3C, and 3K. Afterward, the unfixed images on the intermediate transfer belt 11 undergo a secondary transfer (also termed a static transfer) onto the recording sheet, performed all at once through the effect of static electricity from the secondary transfer roller 47. A transfer voltage is applied to the secondary transfer roller 47 through control by the control unit 60, the transfer voltage having opposite polarity to the toner (here, for example, the toner polarity is taken to be negative).

The recording sheet having the unfixed images having undergone the static transfer is in turn transported to the fixing device 5, where the unfixed images on the recording sheet are thermally fixed onto the recording sheet through the application of heat and pressure by the fixing device 5.

For one-side printing, the recording sheet is expelled from the image forming device 1 by an exit roller 71, after the thermal fixing. For both-side printing, the recording sheet having undergone thermal fixing on one side (here, a front side for example) is transported by the exit roller 71, then transported from the exit roller 71 along a reverse transport channel 75 via transport rollers 73, 74, 76, and 77, and then transported to a later-described timing roller 45 while flipped from back to front. This change of transport channel is performed by a channel switching member 72. The operations of the channel switching member 72 are controlled by the control unit 60.

Subsequently, the recording sheet is transported to a secondary transfer position 46 by the timing roller 45, an unfixed image is statically transferred onto the other side (here, a back side for example) of the recording sheet by the secondary transfer roller 47, and the recording sheet is expelled from the image forming device 1 by the exit roller 71 after thermal fixing by the fixing device 5.

Accordingly, it is possible to statically transfer and heat-fix an unfixed image onto the other side of the recording sheet, onto which an unfixed image has not been statically transferred at the point when the one-side printing is completed.

The feed unit 4 includes a paper feed cassette 41 containing the recording sheet, represented by the symbol P, a feed roller 42 feeding the recording sheet in the paper feed cassette 41 one at a time onto a transport channel 44, a transport roller 43 transporting the recording sheet, once fed, to the timing roller 45, and the timing roller 45 transporting the recording sheet, once transported, to the secondary transfer position 46 with transmission timing. A sheet passing sensor 81 is provided along the transport channel 44 between the timing roller 45 and the secondary transfer position 46, and detects passing of the recording sheet.

The paper feed cassette 41 is not limited to being singular, and may also be provided in plurality. The recording sheet may be provided as a plurality of varieties of paper differing in size or thickness (regular paper, thick paper, and the like), and film sheet such as an overhead projector (hereinafter, OHP) may also be used. When the paper feed cassette 41 is provided in plurality, recording sheets differing in terms of size, thickness, or quality may be contained in the respective paper feed cassettes.

The timing roller 45 transports the recording sheet to the secondary transfer position 46 in accordance with timing at which each unfixed image having undergone the primary transfer on the intermediate transfer belt 11 is transported to the secondary transfer position 46 to achieve overlay transfer at the same position on the intermediate transfer belt 11. Next, at the secondary transfer position 46, the unfixed images on the intermediate transfer belt 11 undergo the static transfer onto the recording sheet all at once, performed by the secondary transfer roller 47.

The various rollers, such as the feed roller 42, the timing roller 45, the exit roller 71, and the transport rollers 73, 74, 76 and 77 have a transport motor (not diagrammed) serving as a drive power source, and are driven to rotate through a power transmission mechanism (not diagrammed) including toothed gears, belts, and the like. The transport motor may be, for example, a stepping motor capable of high-precision rotation speed control.

The fixing device 5 includes a heat roller 51 (here, for example, the heat roller is heated by a heater) and a pressure roller 52 pressing the heat roller 51. A fixing nip is formed between the rollers, and the thermal fixing of the unfixed image occurs at the fixing nip. The position at which the fixing nip is formed is hereinafter termed a fixing position, and is indicated by reference sign 53 in FIG. 1.

Also, a heat roller temperature sensor 500 is provided in the vicinity of the heat roller 51, and measures a surface temperature of the heat roller 51. The control unit 60 controls the surface temperature of the heat roller 51 by controlling the power supplied to the heat roller 51 (or to the heater of the heat roller 51).

Although not illustrated, the fixing device 5 is provided with a frame supporting both longitudinal ends of each of the heat roller 51 and the pressure roller 52, and covering these components. The frame is provided with a gap, as required, in the vicinity of the entrance and exit for the recording sheet and in the vicinity of where the frame supports the longitudinal ends of the heat roller 51 and the pressure roller 52.

[2] Control Unit Configuration

Figure 2:
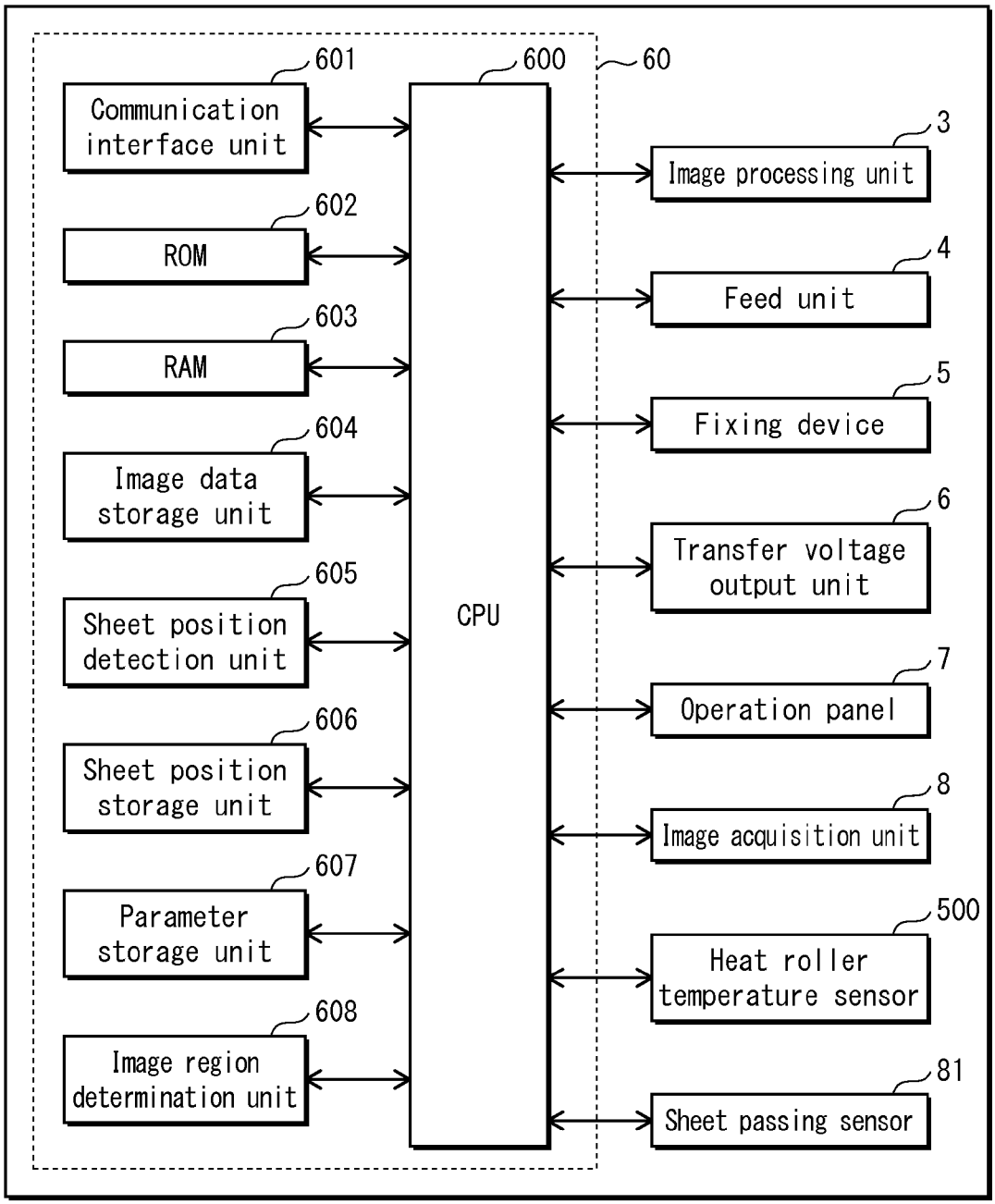
FIG. 2 depicts the configuration of a control unit 60 and the relationship between the control unit 60 and main components subject to control.

FIG. 2 depicts the configuration of the control unit 60 and the relationship between the control unit 60 and the main components subject to control. The control unit 60 is a computer that, as depicted, includes a central processing unit (hereinafter, CPU) 600, a communication interface unit 601, read-only memory (hereinafter, ROM) 602, random access memory (hereinafter, RAM) 603, an image data storage unit 604, a sheet position detection unit 605, a sheet position storage unit 606, a parameter storage unit 607, and an image region determination unit 608.

The communication interface unit 601 is an interface for connecting to a local area network (hereinafter, LAN) such as a LAN card, a LAN port, or the like. The ROM 602 stores programs for controlling the image processing unit 3, the feed unit 4, the fixing device 5, a transfer voltage output unit 6, an operation panel 7, an image acquisition unit 8, the heat roller temperature sensor 500, and the sheet passing sensor 81, as well as programs for executing a later-described fixing temperature control process and both-side printing transfer voltage control process.

The RAM 603 is used as a work area by the CPU 600 during program execution.

The image data storage unit 604 stores image data for printing, input through the communication interface unit 601 and the image acquisition unit 8.

The sheet position detection unit 605 counts a quantity of drive pulses of the transport motor after a leading edge of the recording sheet has passed the sheet passing sensor 81, and thereby calculates a transport distance of the recording sheet relative to the sheet passing sensor 81 and detects current positions of the leading edge and a trailing edge of the recording sheet along the transport channel 44. The quantity of drive pulses is, for example, detectable by counting the drive pulses supplied to the transport motor by the control unit 60.

The sheet position storage unit 606 stores a quantity of drive pulses corresponding to each of the secondary transfer position 46 and the fixing position 53, and a quantity of drive pulses pertaining to the size of the recording sheet.

Specifically, the sheet position storage unit 606 stores each of the quantity of drive pulses corresponding to the transport distance between a detection position of the sheet passing sensor 81 and the secondary transfer position 46, the quantity of drive pulses corresponding to the transport distance between the detection position of the sheet passing sensor 81 and the fixing position 53, and the quantity of drive pulses required to perform transport over a distance corresponding to the size of the recording sheet in a sheet passing direction.

The sheet position detection unit 605 compares the counted quantity of drive pulses to the respective quantities of drive pulses stored in the sheet position storage unit 606 corresponding to the secondary transfer position 46 and to the fixing position 53, and detects the leading edge of the recording sheet as reaching the secondary transfer position 46 and the fixing position 53 when the counted quantity of drive pulses reaches the respective quantity of drive pulses used for comparison. The sheet position detection unit 605 also compares the respective quantity of drive pulses counted once the leading edge reaches the secondary transfer position 46 and the fixing position 53 to the quantity of drive pulses required to perform transport of the distance corresponding to the size of the recording sheet in the sheet passing direction, and detects the trailing edge of the recording sheet as reaching the secondary transfer position 46 and the fixing position 53 when the counted quantity of drive pulses reaches the respective quantity of drive pulses used for comparison.

The parameter storage unit 607 stores an economy temperature, an upper limit temperature, a lower limit transfer voltage, an upper limit transfer voltage, and a transfer voltage calculation formula. Here, the economy temperature is a temperature at which thermal fixing of a text image is possible, and is a lower limit thermal fixing temperature at which the surface temperature of the heat roller 51 is maintained during thermal fixing by the image forming device 1. Also, the upper limit temperature is a temperature at which thermal fixing of a color image is possible, and is an upper limit thermal fixing temperature at which the surface temperature of the heat roller 51 is maintained during thermal fixing of the image forming device 1.

The economy temperature and the upper limit temperature are determined in advance by the manufacturer of the image forming device 1 through testing or the like. Here, for example, the economy temperature is 150° C. and the upper limit temperature is 165° C.

The lower limit transfer voltage is the transfer voltage to be applied during both-side printing, when thermal fixing has been performed on one side at the economy temperature, and the static transfer of the unfixed image is performed on the other side. Here, for example, the lower limit transfer voltage is 500 V.

The upper limit transfer voltage is the transfer voltage applied during both-side printing when thermal fixing has been performed on one side at the upper limit temperature, and the static transfer of the unfixed image is performed on the other side. Here, for example, the upper limit transfer voltage is 800 V. The lower limit transfer voltage and the upper limit transfer voltage are determined in advance by the manufacturer of the image forming device 1 through testing or the like.

The transfer voltage calculation formula is used in the later-described both-side printing transfer voltage control process to calculate the transfer voltage (V) applied when the other side of the recording sheet passes the secondary transfer position 46. Specifically, the following formula is stored.

$$V=((T-Tec)/(Tmax-Tec))\times(Vmax-Vmin)+Vmin$$

In the above-described formula, Tec represents the economy temperature, Tmax represents the upper limit temperature, Vmax represents the upper limit transfer voltage, and Vmin represents the lower limit transfer voltage. Also, T represents a fixing position temperature (index temperature of the sheet temperature) at a sampling sheet position. Fixing position temperatures are acquired during the later-described both-side printing transfer voltage control process. Here, sampling sheet positions are positions of the recording sheet in the sheet passing direction at which the fixing position temperatures are acquired upon passing the fixing position 53, in a later-described sheet passing direction fixing temperature distribution sampling process.

Each fixing position temperature is an index value representing a relative water content at the corresponding sampling sheet position (a higher fixing position temperature being indexed to lower water content). Here, surface temperatures of the heat roller 51 detected by the heat roller temperature sensor 500 when the recording sheet passes the fixing position 53 is used as the fixing position temperatures.

Figure 3:
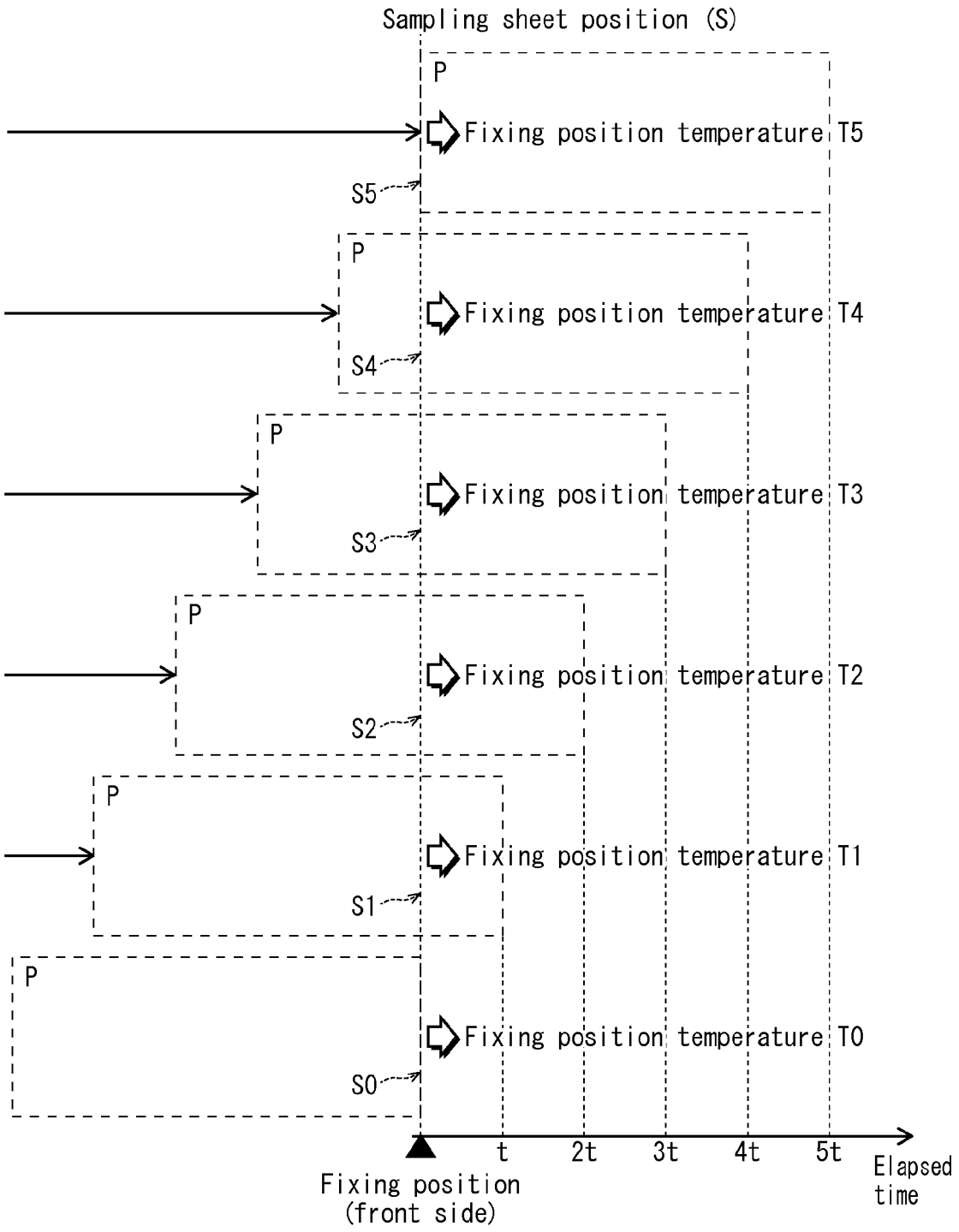
FIG. 3 schematically describes the relationship between sampling sheet positions and fixing position temperatures.

FIG. 3 describes the relationship between the sampling sheet positions and the fixing position temperatures. Here, the dashed rectangles having the reference sign P each represent the recording sheet, and the solid-line arrows represent the sheet passing direction of the recording sheet (i.e., the transport direction toward the fixing position 53 (marked by the black triangle)). FIG. 3 indicates how the recording sheet P gradually travels in the sheet passing direction as time elapses. In specific, FIG. 3 indicates a course along which the recording sheet P travels during the period of time from when the leading edge of the recording sheet P passes through the fixing position 53 until when the trailing edge of the recording sheet P passes through the fixing position 53. The amount of time having elapsed (elapsed time) from when the leading edge of the recording sheet P passes through the fixing position 53 increases from the bottom to the top of the image.

Dashed arrows S0 through S5 indicate the respective sampling sheet positions on the recording sheet P at which the fixing position temperatures (i.e., fixing temperatures T0 through T5) are acquired. Here, the fixing position temperatures are acquired at a predetermined time interval t between the period from when the leading edge of the recording sheet P passes through the fixing position 53 (taken as time 0) until when the trailing edge of the recording sheet P passes through the fixing position 53.

FIG. 4 is a table indicating the relationship between the sampling sheet positions illustrated in FIG. 3, the elapsed time since the passing of the leading edge of the recording sheet P through the fixing position 53 in FIG. 3, and the fixing position temperatures.

In the later-described sheet passing direction fixing temperature distribution sampling process, as described above, the fixing position temperatures are acquired at a predetermined interval while the recording sheet passes through the fixing position 53, and the fixing position temperatures so acquired are used as the index value of water content at each position in the sheet passing direction of the recording sheet (i.e., each sampling sheet position).

Returning to FIG. 2, in the above-described formula, the transfer voltage (V) is the lower limit transfer voltage (Vmin) when T is the economy temperature (Tec), the transfer voltage (V) is the upper limit transfer voltage when T is the upper limit temperature (Tmax), and the transfer voltage (V) increases within a range not exceeding the upper limit transfer voltage (Vmax) for increasing values of T (i.e., for lower water content) when T is between the economy temperature and the upper limit temperature.

Accordingly, the transfer voltage is determined for each sampling sheet position using the above-described formula, which enables the transfer voltage to be determined so as to cancel out the effect of changes in electrical resistance caused by variations in water content.

For example, when the water content is low and the electrical resistance is high at a given sampling sheet position of the recording sheet, then the transfer voltage flows through the given sampling sheet position with difficulty. As such, in this case, the transfer voltage (V) is determined such that the absolute value of the transfer voltage applied at the given sampling sheet position is relatively large. This enables the effect of the above-described variations to be canceled out.

The image region determination unit 608 determines, in accordance with image data for each page, whether an image represented by image data is a color image or a monochrome image, and whether or not an image represented by the image data includes a photographic image.

The determination of whether or not an image is a color image is made, for example, by counting a quantity of pixels to which each color of toner Y, M, C, and K is applied (hereinafter termed toner-applied pixels) within the image data and determining whether or not the quantity of pixels is zero for three of the colors. That is, when the quantity of toner-applied pixels is zero for three colors, the image is found to be a monochrome image, and otherwise the image is found to be a color image.

Also, the determination of whether or not the image data includes a photographic image is made, for example, by acquiring, in each of a main scan direction and a sub-scan direction, a distribution of a total pixel quantity within the image data for printing one page stored in the image data storage unit 604, and making the determination by detecting regularity in the distribution.

When regularities are found in the entirety of the image data for one page, or when the image data is found to include portions of regularity and blank portions, then the image in that page is found not to include a photographic image. Conversely, when regularity is observed only in a part of the image or when no regularity is observed in the entirety of the image, then the image is found to include a photographic image.

For a text image, the total quantity of toner-applied pixels is zero in the spaces between rows and columns in which the text is arranged. Thus, regularity is observed wherever these portions having zero toner-applied pixels repeat with regular spacing. Detecting such regularity enables the determination to be made. (See also Japanese Patent Application Publication No. 2007-259466, paragraphs 0058 through 0060 and FIGS. 6 and 7.)

Also, when image data written in page description language (hereinafter, PDL) is acquired from a terminal device, the determination of whether or not each page of image data includes a photographic image may be made by analysis of the PDL.

The CPU 600 controls the image processing unit 3, the feed unit 4, the fixing device 5, a transfer voltage output unit 6, the operation panel 7, the image acquisition unit 8, the heat roller temperature sensor 500, and the sheet passing sensor 81, by executing the programs stored in the ROM 602, and executes the later-described fixing temperature control process and both-side printing transfer voltage control process.

The transfer voltage output unit 6 applies the transfer voltage to the secondary transfer roller 47. The transfer voltage is applied in accordance with control by the control unit 60. The operation panel 7 includes a liquid crystal display, a touch panel superposed on the liquid crystal display or operation buttons for various input, and the like. The operation panel 7 receives input of various instructions from a user via the touch panel, the operation buttons, or the like.

The image acquisition unit 8 includes an image input device such as a scanner, and forms image data by acquiring text, shapes, pictures, and similar image information from a recording sheet of paper or the like.

[3] Fixing Temperature Control Process

Figure 5:
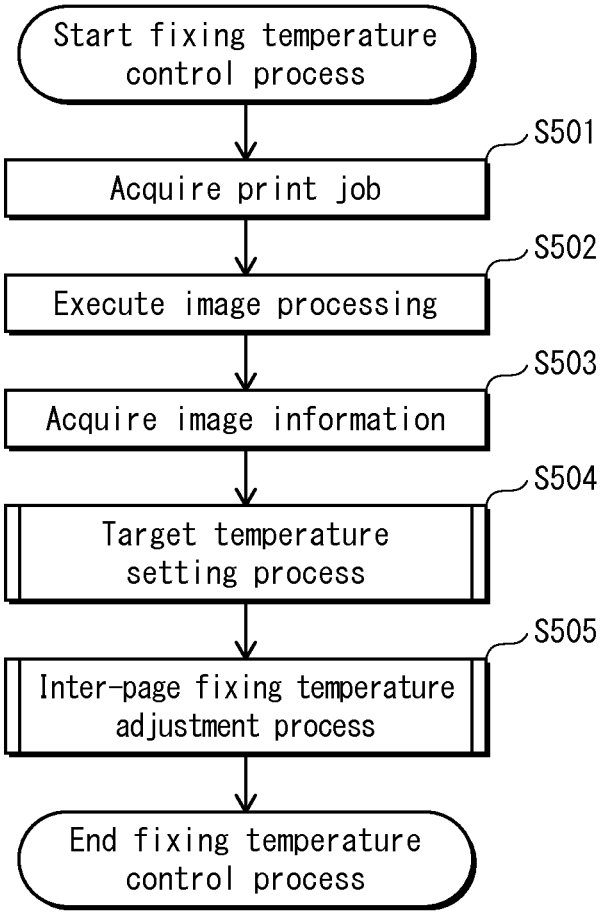
FIG. 5 is a flowchart indicating operations of a fixing temperature control process performed by the control unit 60.

FIG. 5 is a flowchart indicating operations of the fixing temperature control process performed by the control unit 60. The control unit 60 acquires a print job indicating image data and printing conditions through the communication interface unit 601 or through the operation panel 7 and the image acquisition unit 8 (step 501), executes image processing on the image data for each page of the acquired print job (step S502), acquires the image data for printing in the bitmap format as image information (step 503), and then executes each of a later-described target temperature setting process and inter-page fixing temperature adjustment process (step S504, step S505).

Figure 6:
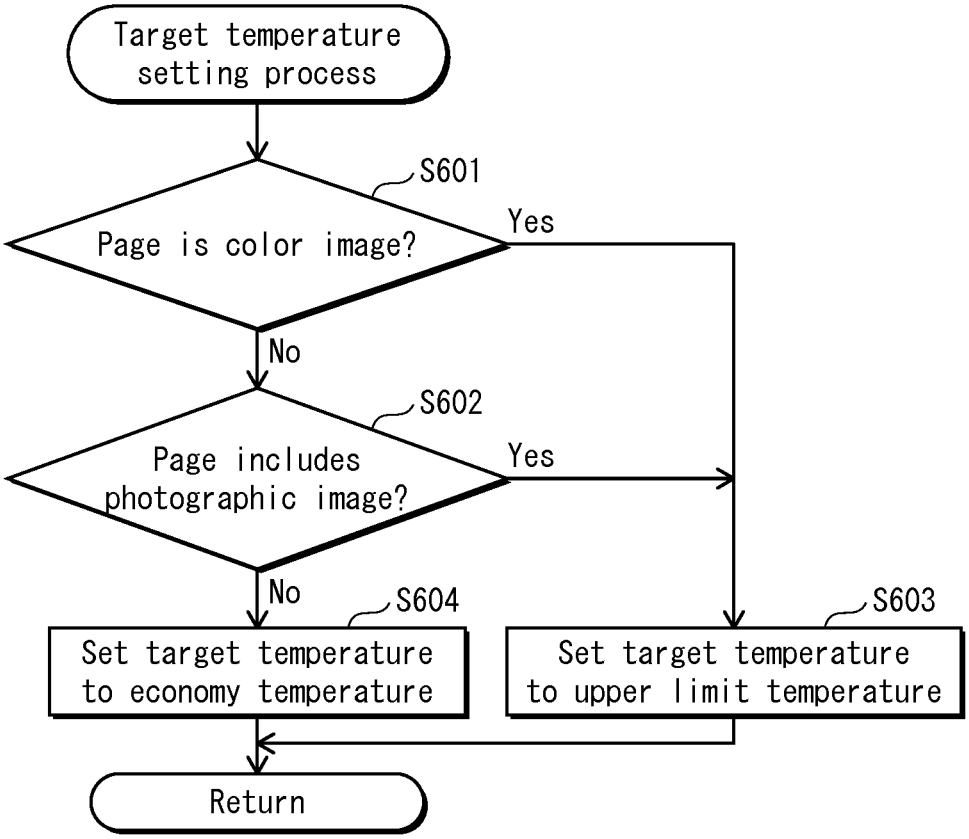
FIG. 6 is a flowchart indicating operations of a target temperature setting process.

FIG. 6 is a flowchart indicating the operations of the target temperature setting process. The control unit 60 determines, based on image information having been acquired corresponding to a given page of the acquired print job, whether or not the image indicated by the image information is a color image (step S601).

When the image indicated by the image information is a color image (YES in step S601), the control unit 60 sets the target temperature at which the surface temperature of the heat roller 51 is to be maintained during thermal fixing of the page to the upper limit temperature (step S603).

When the image indicated by the image information for the page is a monochrome image (NO in step S601), the control unit 60 further determines whether or not the image indicated by the image information includes a photographic image (step S602).

When the result of step S602 is negative (NO in step S602), the control unit 60 sets the target temperature for the page to the economy temperature (step S604).

When the result of step S602 is affirmative (YES in step S602), the control unit 60 transitions to step S603.

Figure 7:
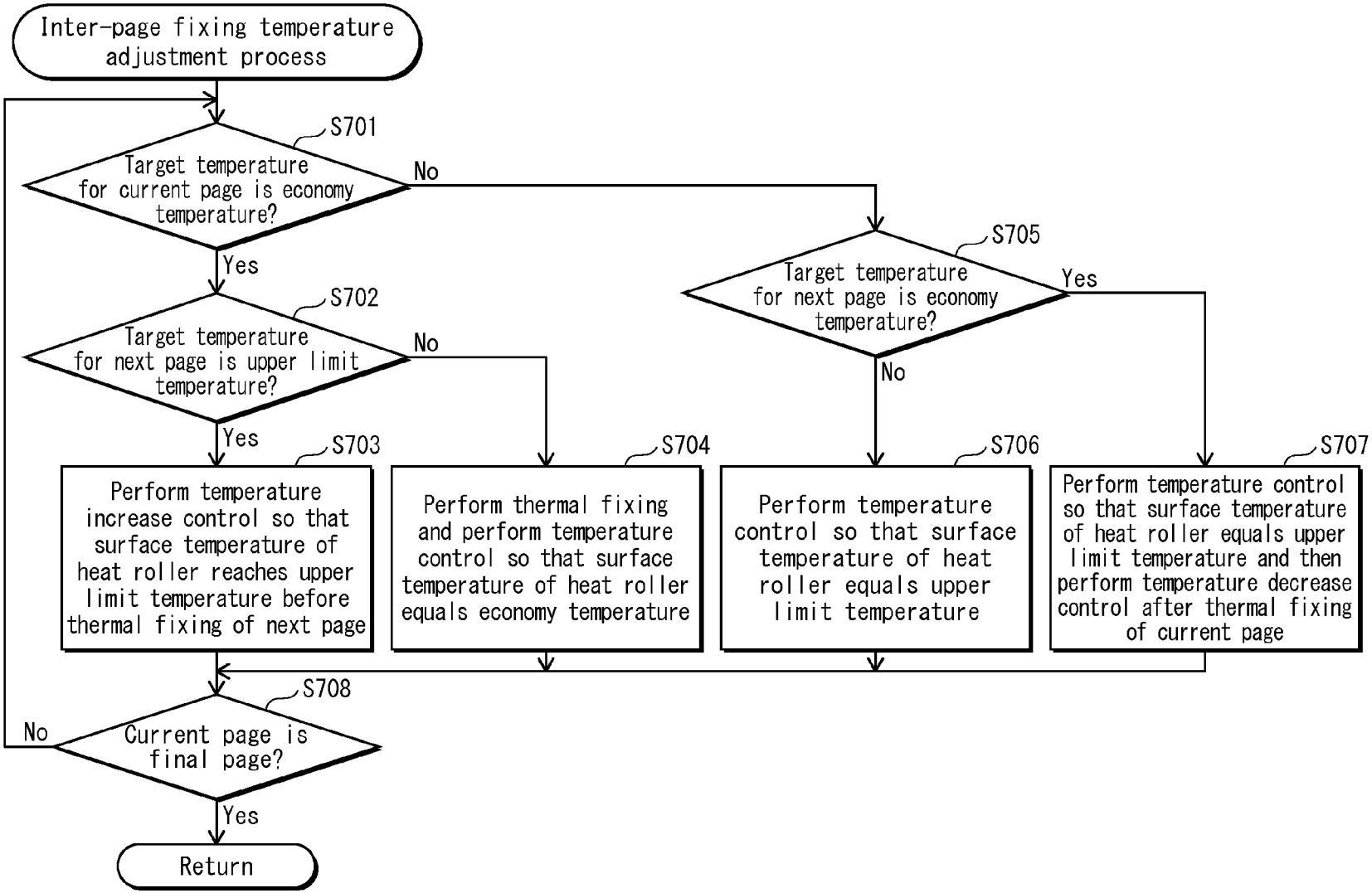
FIG. 7 is a flowchart indicating operations of an inter-page fixing temperature adjustment process.

FIG. 7 is a flowchart indicating the operations of the inter-page fixing temperature adjustment process. The control unit 60 performs the printing process for each page of the acquired print job, and upon beginning the print process for a given page, determines whether or not the target temperature set for the page is the economy temperature (step S701).

When the result of step S701 is affirmative (YES in step S701), the control unit 60 further determines whether or not the target temperature for a page following the current page is set to the upper limit temperature (step S702).

When the result of step S702 is affirmative (YES in step S702), the control unit 60 controls electric power supplied to the heat roller 51 so that, after beginning thermal fixing of the current page at the economy temperature, the surface temperature of the heat roller 51 reaches the upper limit temperature by the beginning of thermal fixing for the next page, thus causing the surface temperature to increase during the thermal fixing of the page (step S703).

When the result of step S702 is negative (NO in step S702), the control unit 60 controls electric power supplied to the heat roller 51 so that the surface temperature of the heat roller 51 is maintained at the economy temperature during the thermal fixing of the page (step S704).

Also, when the target temperature for a previous page preceding the current page is the upper limit temperature, the control unit 60 stops the electric power supply to the heat roller 51 upon beginning the thermal fixing of the current page until the surface temperature reaches the economy temperature, thus causing the surface temperature to decrease to the economy temperature.

Also, when the result of step S701 is negative (NO in step S701), the control unit 60 further determines whether or not the target temperature for the page following the current page is set to the economy temperature (step S705). When the result of step S705 is negative (NO in step S705), the control unit 60 then controls electric power supplied to the heat roller 51 so that the surface temperature of the heat roller 51 is maintained at the upper limit temperature during the thermal fixing of the page (step S706).

Conversely, when the result of step S705 is affirmative (YES in step S705), the control unit 60 controls the electric power supplied to the heat roller 51 to maintain the surface temperature of the heat roller 51 at the upper limit temperature, similarly to the process of step S706, and once the period for thermal fixing the current page ends, stops the electric power supply to the heat roller 51 and causes the surface temperature to decrease (step S707).

The control unit 60 then transitions to step S701 when the current page is not a final page (NO in step S708).

[4] Both-Side Printing Transfer Voltage Control Process

Figure 8:
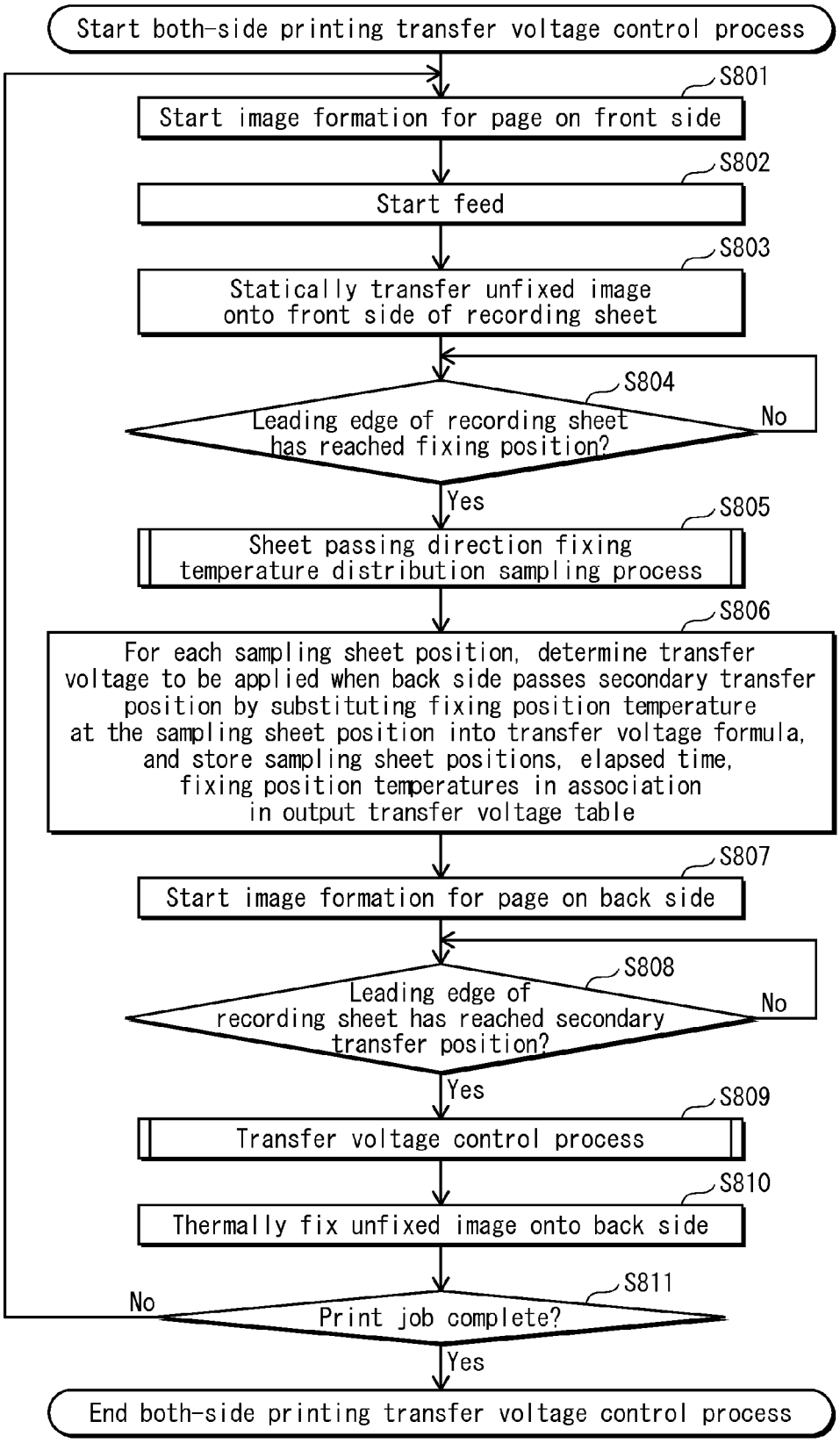
FIG. 8 is a flowchart indicating operations of a both-side printing transfer voltage control process performed by the control unit 60.

FIG. 8 is a flowchart indicating the operations of the both-side printing transfer voltage control process performed by the control unit 60. When the acquired print job indicates both-side printing as a print condition, the control unit 60 causes the image processing unit 3 to begin image formation for a page on the front side (step S801), and once an image for the page on the front side is formed, causes the feed unit 4 to begin feeding a recording sheet (step S802), applies a predetermined transfer voltage to the secondary transfer roller 47 through the transfer voltage output unit 6, and statically transfer the unfixed image formed by the image processing unit 3 onto the front side of the recording sheet at the secondary transfer position 46 (step S803).

Then, once the leading edge of the recording sheet reaches the fixing position 53 after the static transfer of the unfixed image onto the front side (YES in step S804), the control unit 60 executes the later-described sheet passing direction fixing temperature distribution sampling process (step S805), substitutes the fixing position temperatures (T) at the sampling sheet positions acquired in step S805 into the transfer voltage formula stored in the parameter storage unit 607, calculates applied transfer voltages (V) to be applied to the back side of the recording sheet when passing the secondary transfer position 46 to determine the applied transfer voltages (V) for the sampling sheet positions, and stores, in the RAM 603, an output transfer voltage table listing the sampling sheet positions, the elapsed time and fixing position temperature pertaining to each of the sampling sheet positions, and the determined applied transfer voltages (V) in correspondence (step S806).

Figures 9, 10:
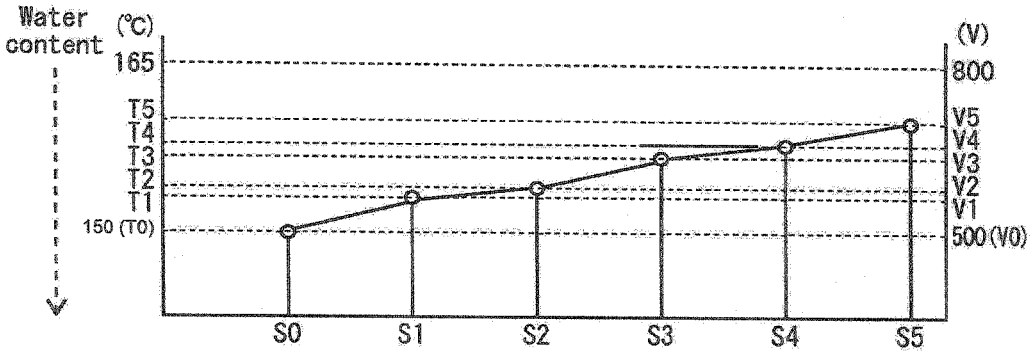
FIG. 9 depicts a specific example of an output transfer voltage table.
FIG. 10 is a graph describing the relationship between the sampling sheet positions, the fixing position temperatures, and applied transfer voltages in the output transfer voltage table.

FIG. 9 is a specific example of the output transfer voltage table. As indicated in FIG. 9, for each of six sampling sheet positions (S0, S1, S2, S3, S4, S5), an elapsed time (0, t, 2*t*, 3*t*, 4*t*, 5*t*), a fixing position temperature (T0, T1, T2, T3, T4, T5), and an applied transfer voltage (V0, V1, V2, V3, V4, V5) are listed in correspondence.

For example, (i) when the target fixing temperature of the page on the front side of the recording sheet is the economy temperature, the target fixing temperature of the page on the back side of the recording sheet, which is the next page, is the upper limit temperature, and thus control for increasing the temperature in step S703 is performed in the inter-page fixing temperature adjustment process in FIG. 7, and (ii) T0=150° C., T1=153° C., T2=154° C., T3=157° C., T4=158° C., T5=160° C., and thus the applied transfer voltages (V) calculated using the transfer voltage formula are V0=500 V, V1=560 V, V2=580 V, V3=640 V, V4=660 V, and V5=700 V, the relationship between the sampling sheet positions, the fixing position temperatures, and the applied transfer voltages in the output transfer voltage table can be illustrated as the graph in FIG. 10.

In FIG. 10, reference signs S0 through S5 indicate the sampling sheet positions, reference signs T0 through T5 indicate the fixing position temperature, and reference signs V0 through V5 indicate the applied transfer voltages calculated using the transfer voltage formula. Also, the dashed arrow indicates the water content, increasing in the direction of the arrow.

As indicated, the applied transfer voltage at a given sampling sheet position is set to have a larger absolute value for a higher fixing position temperature at the sampling sheet position and thus lower water content at the sampling sheet position.

Returning to FIG. 8, the control unit 60 then causes the image processing unit 3 to begin forming an image for the page on the back side (step S807) and, once the image for the page has been formed, causes the feed unit 4 to begin feeding the recording sheet. Then, once the leading edge of the recording sheet that is fed is detected at the secondary transfer position 46 (YES in step S808), the control unit 60 executes the later described transfer voltage control process (step S809) and causes the fixing device 5 to thermally fix the unfixed image having been statically transferred onto the back side of the recording sheet (step S810).

Note that a non-diagrammed sheet passing sensor is provided at a predetermined position along the reverse transport channel 75. Once this sheet passing sensor detects the passing of the recording sheet and the sheet passing sensor 81 detects passing of the recording sheet after an interval of time corresponding to a transport distance from the position of the non-diagrammed sheet passing sensor to the detection position of sheet passing sensor 81 has elapsed, the control unit 60 performs the above-described processing of step S809.

The processing of steps 801 through S810 is then repeated until the print job is complete (YES in step S811).

Figure 11:
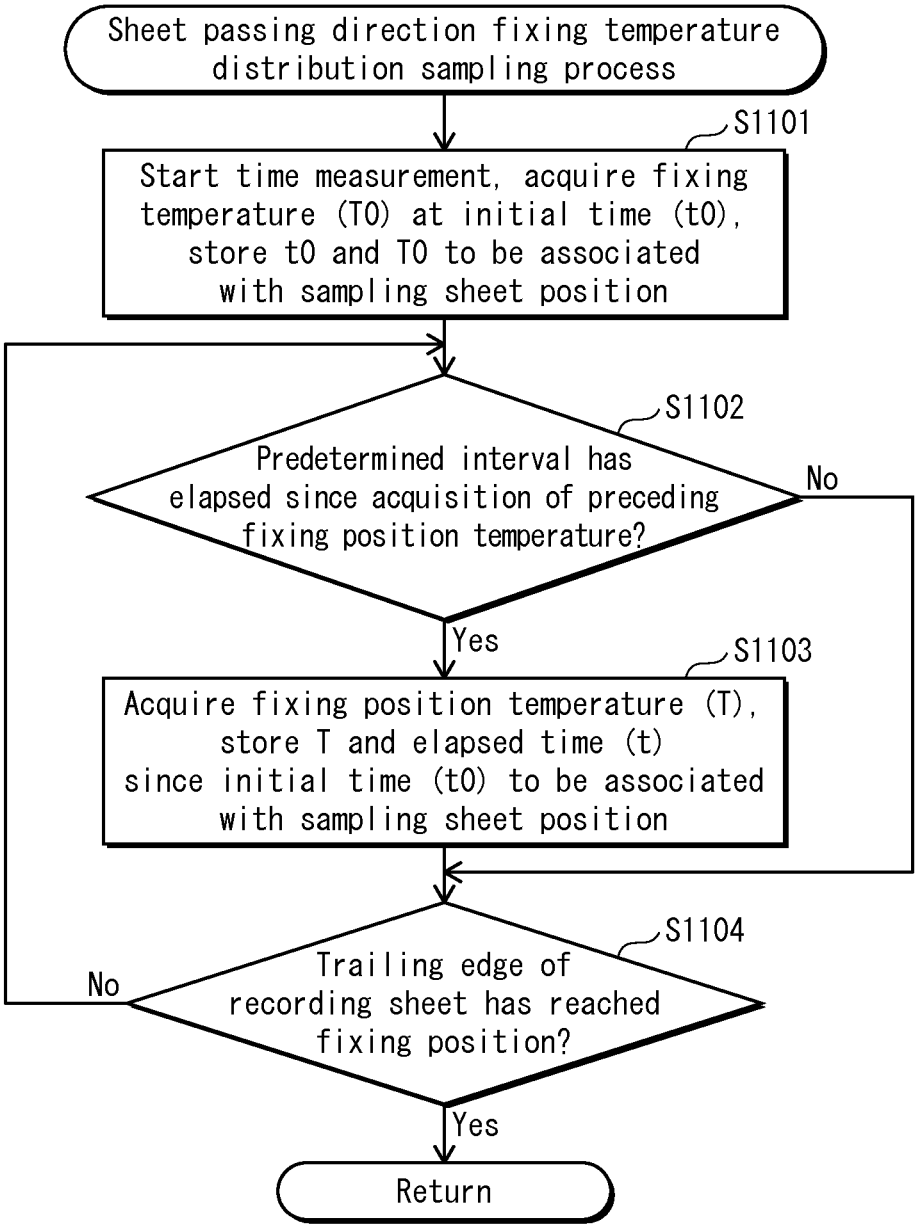
FIG. 11 is a flowchart indicating operations of a sheet passing direction fixing temperature distribution sampling process.

FIG. 11 is a flowchart indicating the operations of the sheet passing direction fixing temperature distribution sampling process. The control unit 60 begins a time measurement and acquires, from the heat roller temperature sensor 500, the fixing position temperature (T0) at the initial time t0 (elapsed time zero seconds) of the time measurement. The values of t0 and T0 are associated with an identifier (S0) for the sampling sheet position at which the fixing position temperature (T0) is acquired and stored in the RAM 603 (step S1101).

Then, once a predetermined interval (here, 20 ms, for example) has elapsed since the preceding acquisition of the fixing position temperature (YES in step S1102), the next fixing position temperature (T) is acquired. The elapsed time since t0 (t) and T are associated with an identifier (S) indicating the sampling sheet position at which the fixing position temperature (T) is acquired, and are stored in the RAM 603 (step S1103).

Next, the control unit 60 determines whether or not the trailing edge of the recording sheet has reached the fixing position 53 (step S1104). Steps S1102 and S1103 are repeated until the trailing edge reaches the fixing position 53 (YES in step S1104).

Figure 12:
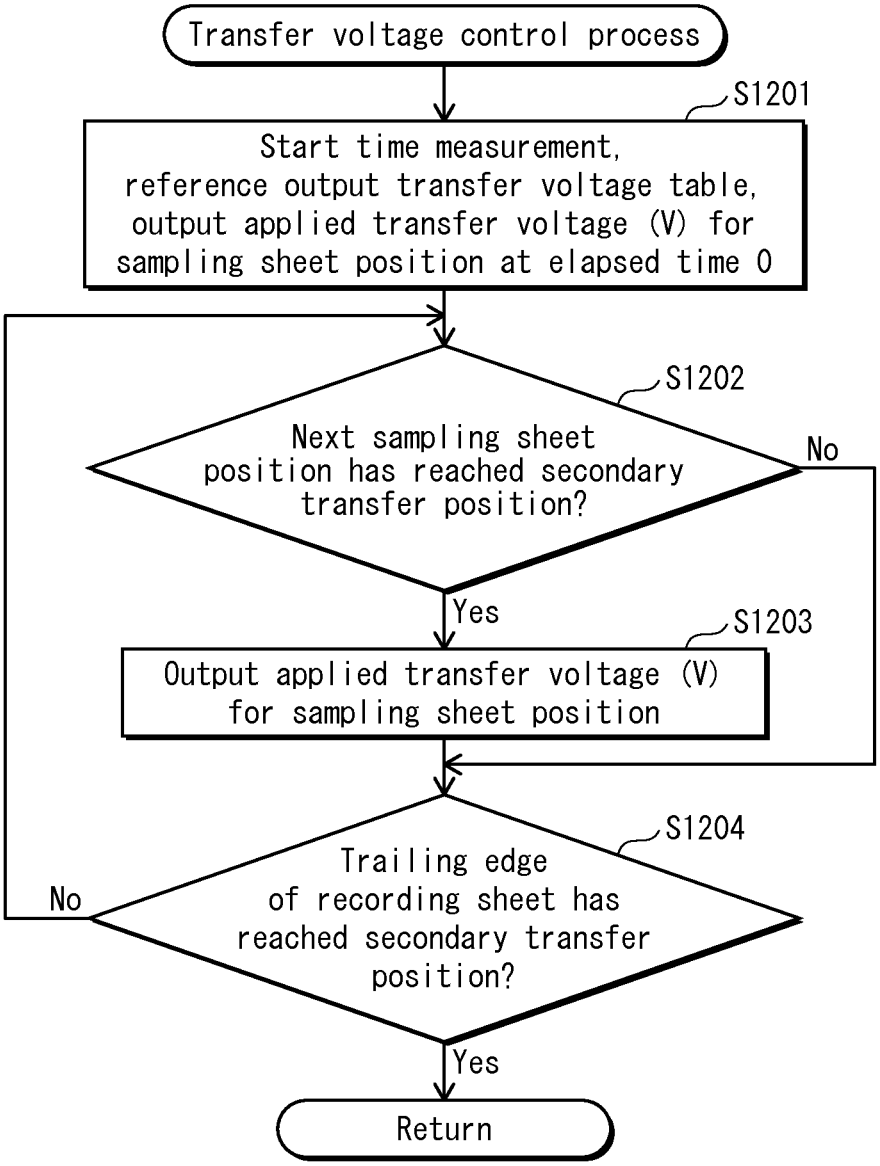
FIG. 12 is a flowchart indicating operations of a transfer voltage control process.

FIG. 12 is a flowchart indicating the operations of the transfer voltage control process. The control unit 60 begins the time measurement and references the output transfer voltage table, then causes the transfer voltage output unit 6 to output the applied transfer voltage V corresponding to the sampling sheet position for elapsed time zero to the secondary transfer roller 47 (step S1201).

Then, at the time when the next sampling sheet position reaches the secondary transfer position 46 (YES in step S1202), the control unit 60 causes the transfer voltage output unit 6 to output the applied transfer voltage (V) corresponding to the next sampling sheet position to the secondary transfer roller 47 (step S1203).

Here, fixing position temperatures are acquired at a predetermined time interval (see steps S1102 and S1103 in FIG. 11). As such, the time at which the next sampling sheet position reaches the secondary transfer position 46 in step S1202 occurs each time the predetermined interval elapses since the arrival of the previous sampling sheet position at the secondary transfer position 46 (e.g., when the predetermined interval elapses since the sampling sheet position for elapsed time zero). Here, the recording sheet is transported to the fixing position 53 and to the secondary transfer position 46 at equal transport speeds.

Next, the control unit 60 determines whether or not the trailing edge of the recording sheet has reached the secondary transfer position 46 (step S1204). Steps S1202 and S1203 are repeated until the trailing edge reaches the secondary transfer position 46 (YES in step S1204).

Figure 13:
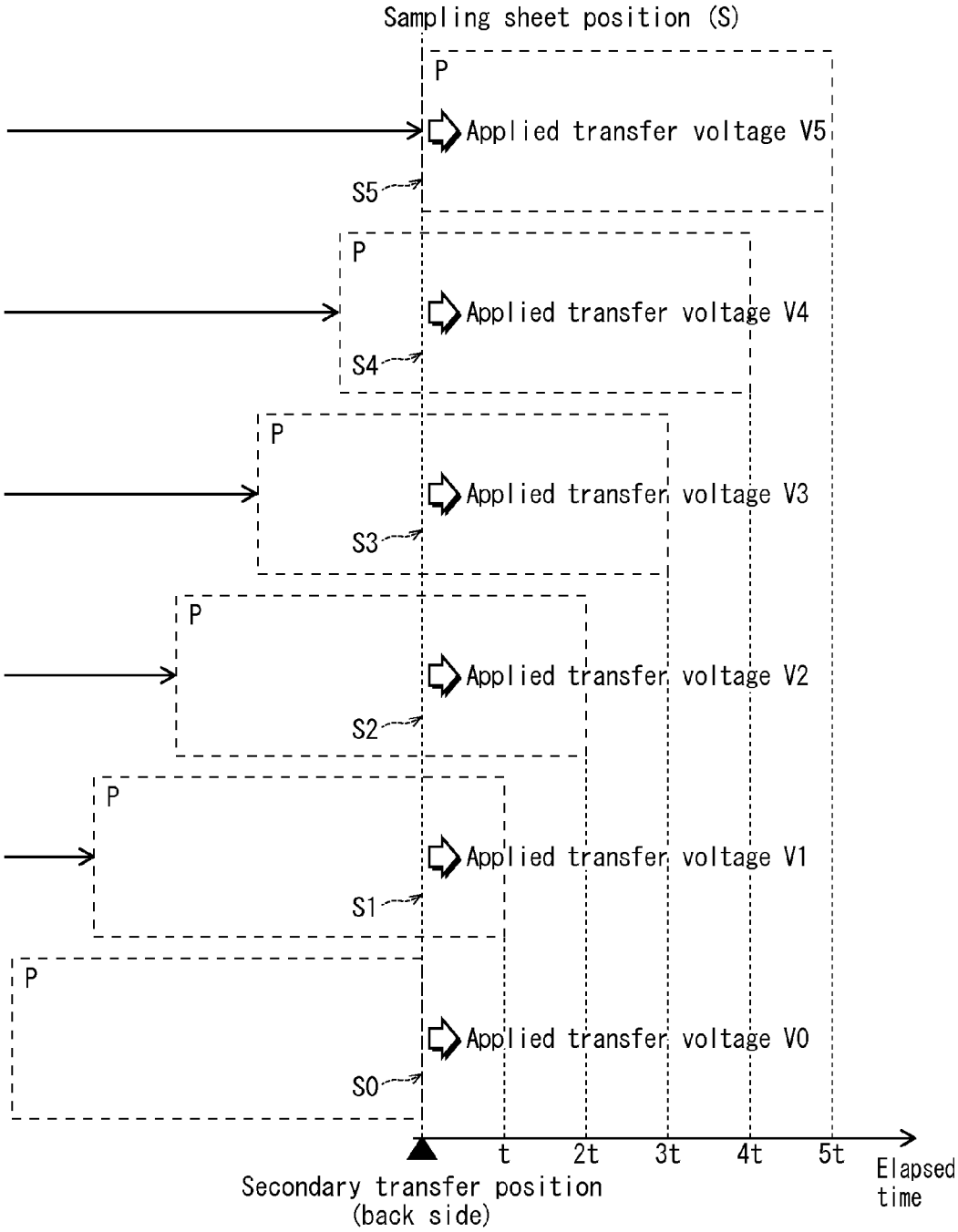
FIG. 13 schematically illustrates how applied transfer voltage that is output is switched each time one of the sampling sheet positions reaches secondary transfer position 46.

FIG. 13 schematically illustrates how the applied transfer voltage that is output is switched each time one of the sampling sheet positions reaches the secondary transfer position 46. Here, the dashed rectangles having the reference sign P each represent the recording sheet, and the solid line arrows represent the sheet passing direction of the recording sheet (i.e., the transport direction toward the secondary transfer position 46 (marked by the black triangle). FIG. 13 indicates how the recording sheet P gradually travels in the sheet passing direction as time elapses. In specific, FIG. 13 indicates a course along which the recording sheet P travels during the period of time from when the leading edge of the recording sheet P passes through the secondary transfer position 46 until when the trailing edge of the recording sheet P passes through the secondary transfer position 46. The amount of time having elapsed (elapsed time) from when the leading edge of the recording sheet P passes through the secondary transfer position 46 increases from the bottom to the top of the image.

In FIG. 13, the positions indicated by dashed arrows S0 through S5 represent the sampling sheet positions, and the white arrows indicate the applied transfer voltages at the sampling sheet positions. Also, as indicated in FIG. 13, the applied transfer voltage V0, V1, V2, V3, V4, and V5 is switched at each of the six sampling sheet positions S0, S1, S2, S3, S4, and S5.

Accordingly, in the present Embodiment, during both-side printing, the fixing position temperature at each sampling sheet position on the front side is acquired as an index of water content during thermal fixing of the front side. Then, when statically transferring an unfixed image onto the back side at the secondary transfer position 46, the transfer voltage applied at the secondary transfer position 46 with respect to each sampling sheet position is set so that the absolute value of the applied transfer voltage increases as the water content indicated by the fixing position temperature at the sampling sheet position decreases. As such, despite variations in water content in the recording sheet during both-side printing, the effect of fluctuations in electrical resistance caused by these variations is canceled out, thus enabling the static transfer of the unfixed image on the back side to be performed without unevenness. As a result, degradation in image quality on the back side is prevented.

(Modifications)

The above description of the disclosure has been provided in terms of the Embodiment. However, no limitation is intended to the above-described Embodiment. The following modifications are also applicable.

(1) In the Embodiment, fixing position temperatures at a plurality of positions along the sheet passing direction are acquired as index values indexing the water content. However, another method may also be used to acquire the index values. For example, an optical water sensor may be used to measure the water content in the recording sheet at a plurality of positions in the sheet passing direction after thermal fixing on the front side. Alternatively, an average temperature increase rate per unit time may be calculated from a difference in target temperatures for pages, and the calculated average temperature increase rate may be used to calculate the temperatures of a plurality of positions in the sheet passing direction after the thermal fixing on the front side, and the temperatures so calculated may be used as the index value.

(2) In the Embodiment, the both-side printing transfer voltage control process is performed during both-side printing to prevent transfer unevenness caused by variations in water content of the recording sheet. However, recording sheet curling may occur during one-side printing due to the variations in water content, depending upon the level of variation. As such, a process of correcting such curling in accordance with the variations in water content may also be performed.

Figure 14:
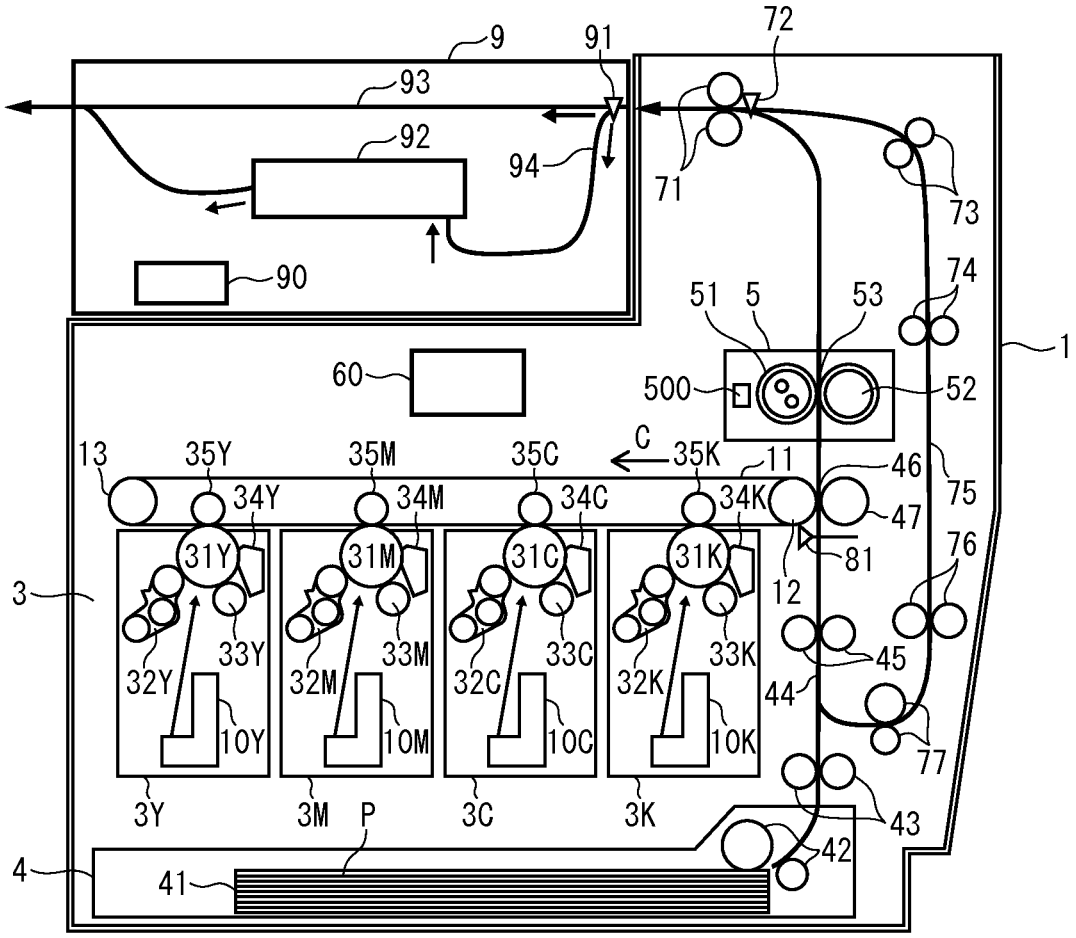
FIG. 14 depicts a modification of the image forming device in FIG. 1.

Specifically, as indicated in FIG. 14, the image forming device 1 may include a post-processing device 9 equipped with a de-curling mechanism, and the control unit 60 may cause the post-processing device 9 to execute a later-described one-side printing curl control process.

The post-processing device 9 includes a post-processing control unit 90, a channel switching member 91, and a de-curling mechanism 92. In the present modification, the recording sheet having undergone thermal fixing of the unfixed image in the fixing device 5 is transported into the post-processing device 9, passes through one of a default transport channel 93 that does not go through the de-curling mechanism 92 and a de-curling transport channel 94 that goes through the de-curling mechanism 92, and then exits the post-processing device 9.

The control unit 60 is able to communicate with the post-processing control unit 90 and controls the operations of the post-processing device 9 via the post-processing control unit 90.

The post-processing control unit 90 includes a CPU, ROM, RAM, and the like, and controls the channel switching member 91 and the de-curling mechanism 92, and performs overall control of the post-processing device 9, in response to an instruction from the control unit 60. The channel switching member 91 is a member switching the transport channel into which the recording sheet is transported, within the post-processing device 9.

Figure 15:
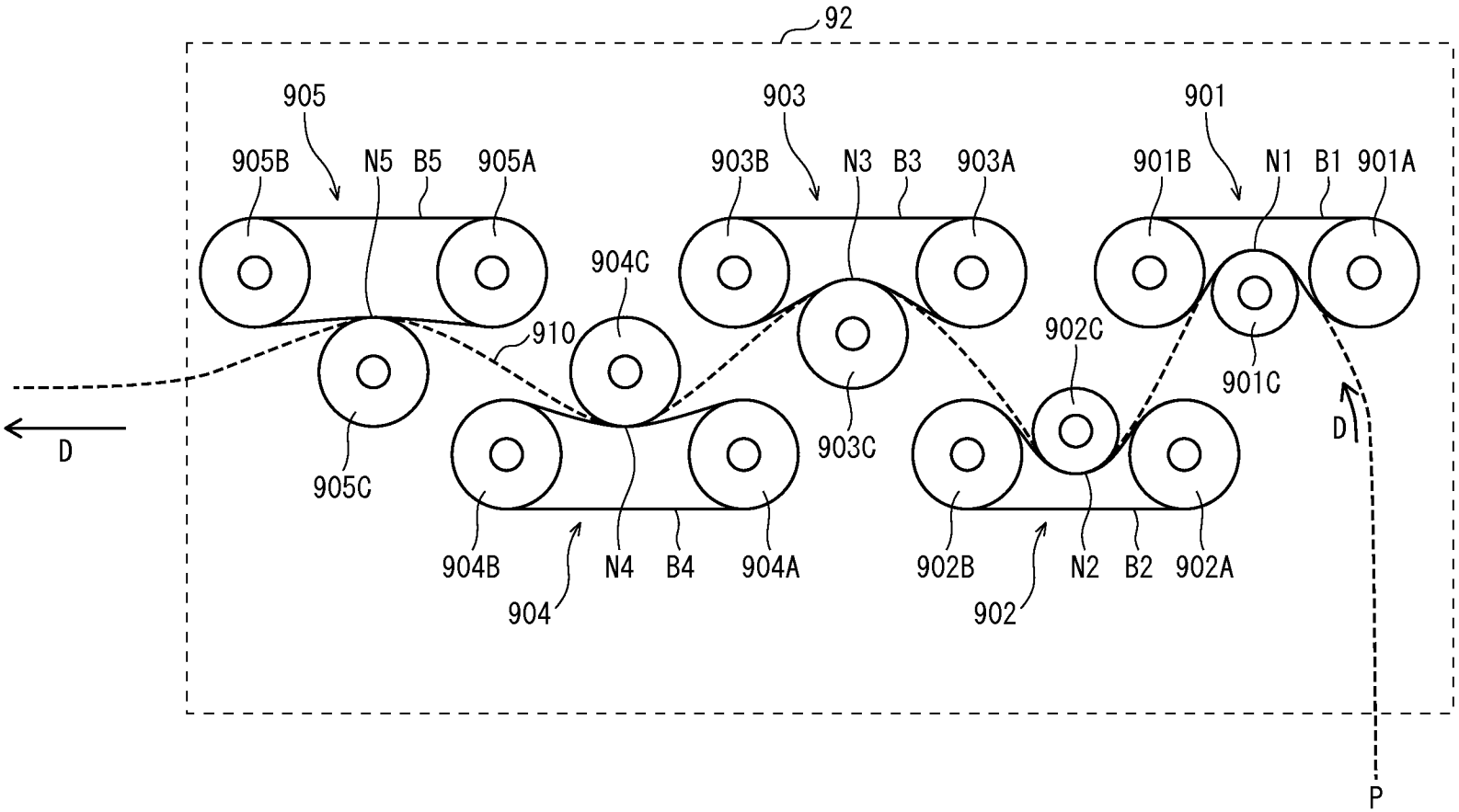
FIG. 15 depicts the configuration of a de-curling mechanism 92.

As illustrated in FIG. 15, the de-curling mechanism 92 includes a plurality of curl correction units 901 through 905 differing in terms of curl correction direction and correction power. Each of the curl correction units 901 through 905 includes three rollers and an endless belt. The endless belts (belts B1 through B5) are respectively extended across two of the rollers while the third roller is in contact with an external circumferential surface of the endless belt and presses the endless belt inward, thus forming nips N1 through N5 between each endless belt and the third roller. The recording sheet P is transported in the direction indicated by arrow D along the transport channel 910 indicated by the dashed line, and sequentially passes through nips N1 through N5. The curling is thus corrected in each of the nips N1 through N5.

In FIG. 15, reference signs 901A, 901B, 902A, 902B, 903A, 903B, 904A, 904B, 905A, and 905B indicate the suspension rollers on which the endless belts B1 through B5 are suspended, and reference signs 901C, 902C, 903C, 904C, and 905C indicate the rollers in external contact with the respective endless belts B1 through B5.

Within the de-curling mechanism 92, the arrangement and size of the rollers are adjusted so that neighboring curl correction units in the transport direction of the recording sheet P apply the curl correction in opposing directions. The curl correction force applied between curl correction units in the same correction direction (i.e., between curl correction units 901, 903, and 905, and between curl correction units 902 and 904) decreases gradually from an upstream side to a downstream side of the transport direction (i.e., the pressure by the roller on the endless belt is smaller and the outer radius of the roller is larger).

Figure 16:
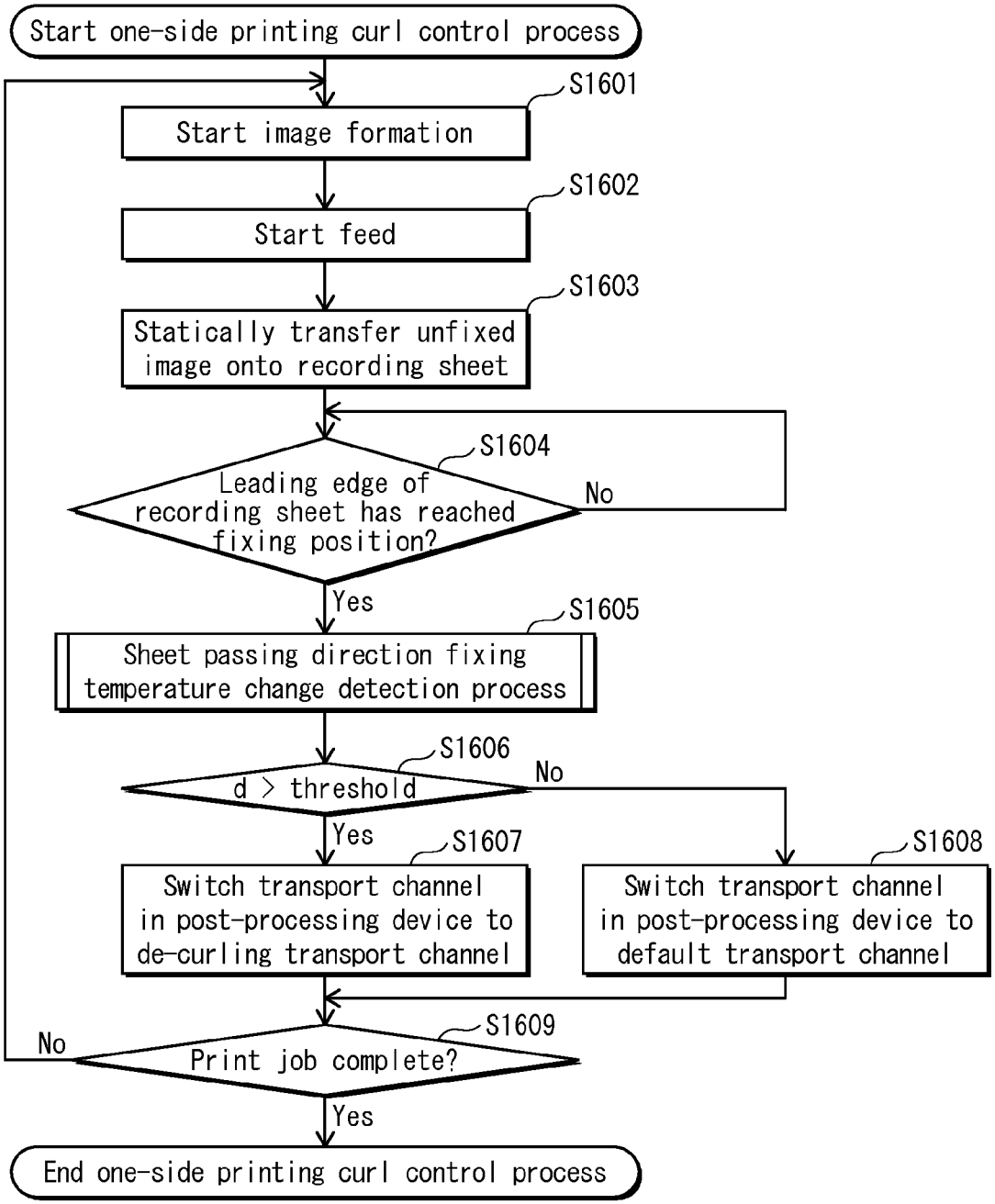
FIG. 16 is a flowchart indicating operations of a one-side printing curl control process performed by the control unit 60.

FIG. 16 is a flowchart indicating the operations of the one-side printing curl control process performed by the control unit 60. The processing of steps S1601 through S1604 is identical to the processing of steps S801 through S804 from FIG. 8, and explanations thereof are thus omitted.

When the result of step S1604 is affirmative (YES in step S1604), the control unit 60 executes a later-described sheet passing direction fixing temperature change detection process (step S1605), and determines whether or not a difference d between a maximum value (Tmax) and a minimum value (Tmin) of the fixing position temperatures in the sheet passing direction during thermal fixing as calculated during step S1605 exceeds a threshold (step S1606).

Here, the threshold is a value corresponding to a tolerable upper limit at which curling does not occur, and is determined through testing or the like and set in advance by the manufacturer of the image forming device.

When the result of step S1606 is affirmative (YES in step S1606), the control unit 60 controls the channel switching member 91 of the post-processing device 9 through the post-processing control unit 90 to switch the transport channel to the de-curling transport channel 94 and transport the recording sheet, having been transported into the post-processing device 9 after thermal fixing, to the de-curling mechanism 92 where the de-curling mechanism 92 applies curl correction to the recording sheet (step S1607).

When the result of step S1606 is negative (NO in step S1606), the control unit 60 controls the channel switching member 91 of the post-processing device 9 through the post-processing control unit 90 to switch the transport channel to the default transport channel 93 and transport the recording sheet, having been transported into the post-processing device 9 after thermal fixing, without passing through the de-curling mechanism 92 and without curl correction being applied to the recording sheet, directly outside the post-processing device 9 (step S1608).

Next, the control unit 60 determines whether or not the acquired print job is complete (step S1609). Steps S1601 through S1608 are repeated until the print job is complete (YES in step S1609).

Figure 17:
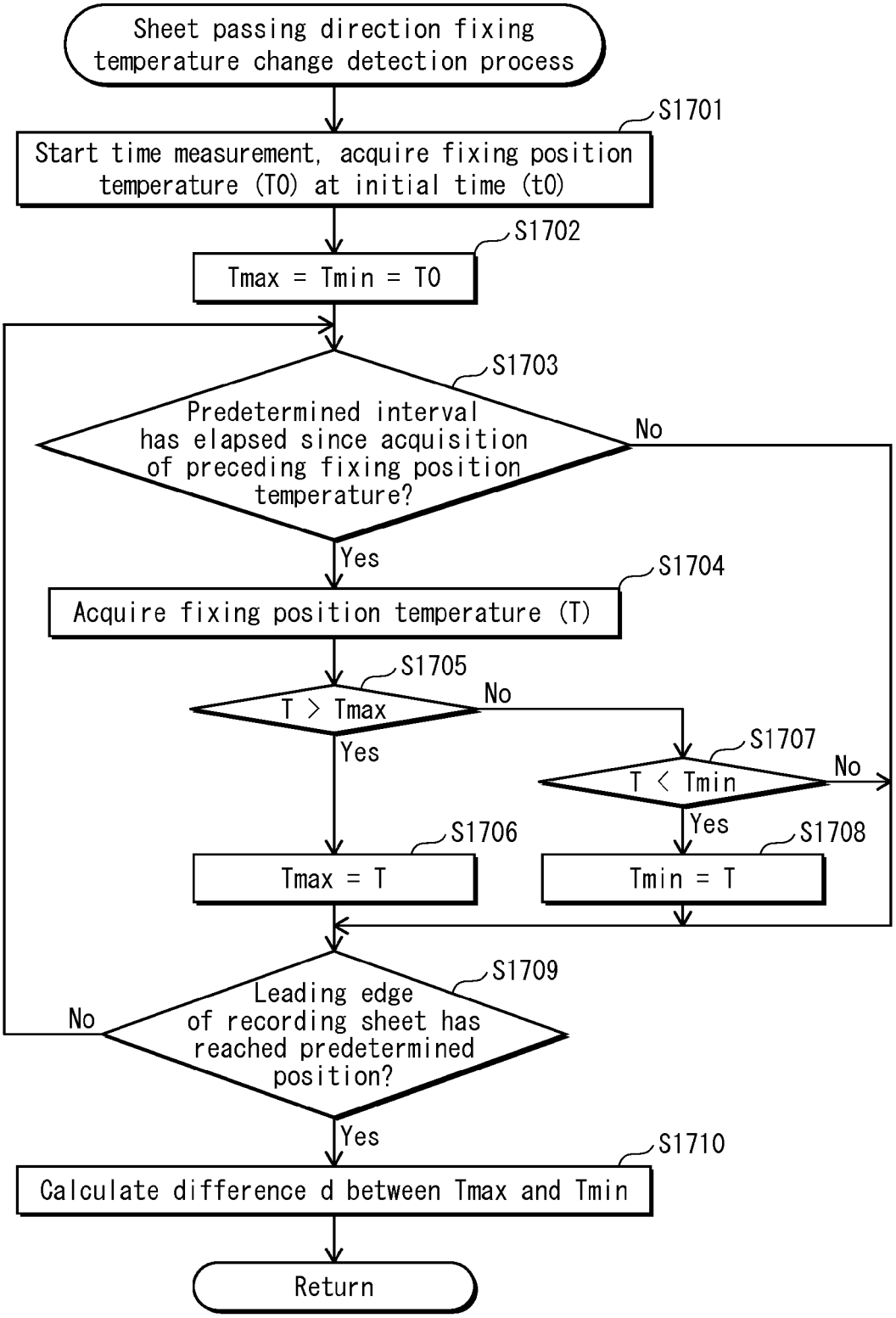
FIG. 17 is a flowchart indicating operations of a sheet passing direction fixing temperature change detection process.

FIG. 17 is a flowchart indicating the operations of the sheet passing direction fixing temperature change detection process. The control unit 60 begins the time measurement and acquires, from the heat roller temperature sensor 500, the fixing position temperature (T0) at the initial time t0 (elapsed time 0 seconds) at the start of the time measurement (step S1701).

The control unit 60 then takes T0 as the value of the variable Tmax indicating the maximum value of the fixing position temperatures and the variable Tmin indicating the minimum value of the fixing position temperatures (step S1702). Once a predetermined interval (here, 20 ms, for example) has elapsed since the acquisition of a previous fixing position temperature (YES in step S1703), the control unit 60 acquires the next fixing position temperature (T) (step S1704).

Next, the control unit 60 compares the values of T and Tmax. When T is greater than Tmax (YES in step S1705), then T is set to the value of Tmax (step S1706). When T is not greater than Tmax (NO in step S1705), the control unit 60 further compares the values of T and Tmin. When T is less than Tmin (YES in step S1707), then T is set to the value of Tmin (step S1708).

Furthermore, the control unit 60 determines whether or not the leading edge of the recording sheet has reached a predetermined position, in accordance with detection results from the sheet position detection unit 605 (step S1709).

Here, the predetermined position is determined by the manufacturer of the image forming device 1 in accordance with the length of the transport channel 44. For example, when the transport channel 44 from the fixing position 53 to the exit to the post-processing device 9 is long, and the leading edge of the recording sheet does not reach the exit by the time the trailing edge of the recording sheet passes the fixing position 53, then the predetermined position is set to a position along the transport channel 44 passed by the leading edge of the recording sheet when the trailing edge reaches the fixing position 53.

Conversely, when the transport channel 44 is short and the leading edge of the recording sheet reaches the exit before the trailing edge of the recording sheet reaches the fixing position 53, then, for example, the position of the exit serves as the predetermined position.

In the above-described circumstances, a drive pulse quantity corresponding to the transport distance from the detection position of the sheet passing sensor 81 to the predetermined position is stored in the sheet position storage unit 606. The control unit 60 compares the drive pulse quantity counted by the sheet position detection unit 605 and the drive pulse quantity corresponding to the distance to the predetermined position, and detects the leading edge of the recording sheet as having reached the predetermined position when the drive pulse quantities being compared are equalized.

Accordingly, step S1606 is performed before the leading edge of the recording sheet is transported into the post-processing device 9, which enables the channel switching member 91 to perform the transport channel switching in time.

Also, when the result of step S1709 is affirmative (YES in step S1709), the control unit 60 calculates the difference d between the maximum value (Tmax) and the minimum value (Tmin) of the fixing position temperatures in the sheet passing direction during thermal fixing (step S1710).

When the result of step S1709 is negative (NO in step S1709), the control unit 60 transitions to step S1703. Also, when the result of step S1707 is negative (NO in step S1707), the control unit 60 transitions to step S1709.

As such, in the present modification, during one-side printing, the fixing position temperatures in the sheet passing direction during thermal fixing are acquired as the index values of water content. When the variation in water content in the sheet passing direction exceeds a threshold, the recording sheet may experience curling. As such, the de-curling mechanism controls curling by applying correction, thus preventing curling caused by the variation in water content during thermal fixing.

Also, within the de-curling mechanism 92, the arrangement of the external rollers may be adjustable such that the amount of pressing by the external rollers with respect to the endless belts changes in accordance with the magnitude of d (the greater the value of d, the greater the amount of pressing).

An actuator or the like may be used as a displacement mechanism for the rollers. Such a displacement mechanism is controlled by the control unit 60 via the post-processing control unit 90 such that the amount of pressing is controlled in accordance with the magnitude of d, and the curl correction is greater for greater values of d. As a result, the curl correction force is adjusted in accordance with the degree of curling, enabling the curl correction to be optimized as neither too weak nor too strong.

(3) Also, in modification (2), when the grammage of the recording sheet is low and mechanical correction is unable to fully correct the curling, then control may be performed to subject the recording sheet to humidification by a humidifier and then perform curl correction in the de-curling mechanism.

Figure 18:
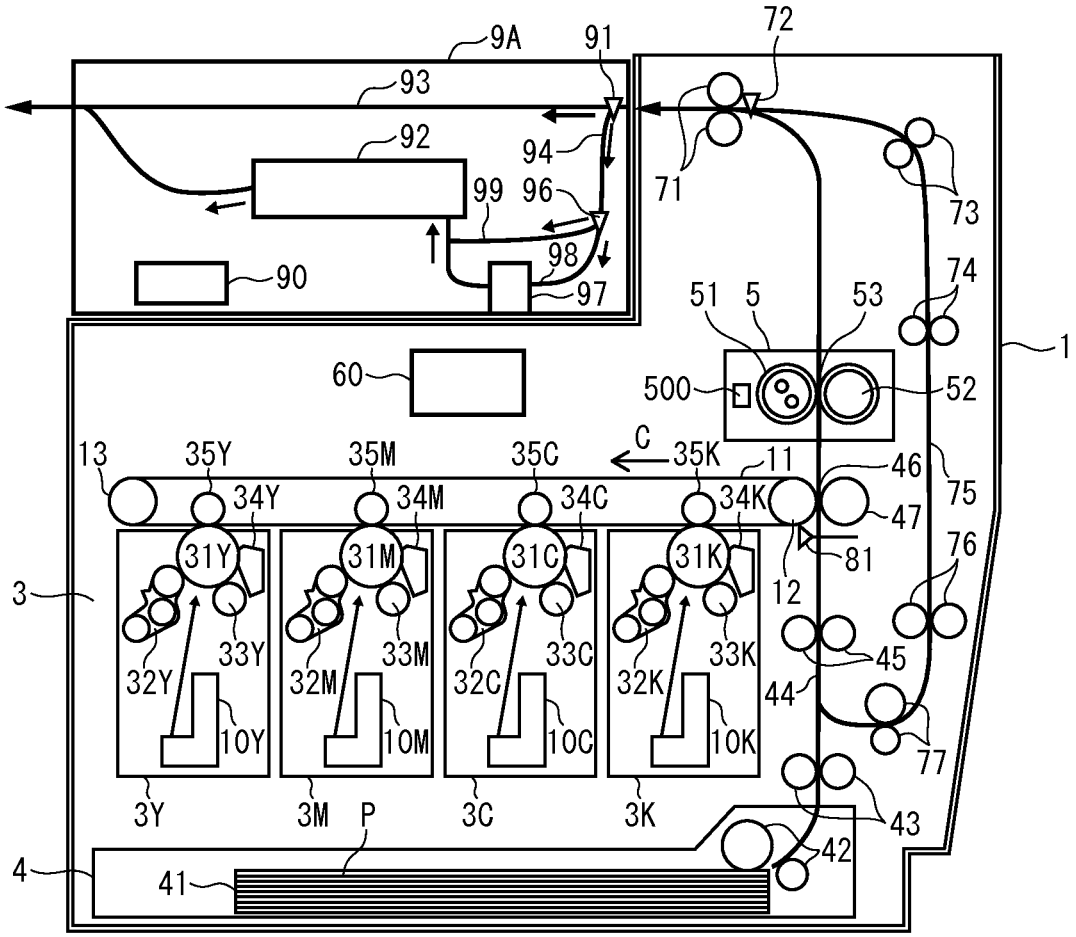
FIG. 18 depicts another modification of the image forming device in FIG. 1.

Specifically, as indicated in FIG. 18, the image forming device 1 may include a post-processing device 9A equipped with a humidifier 97 and a de-curling mechanism 92, and the control unit 60 may cause the post-processing device 9A to execute a later-described one-side printing curl control process.

The post-processing device 9A of FIG. 18 is configured similarly to the post-processing device 9 of FIG. 14. As such, the same reference signs are used and explanations of similar components are omitted. The following mainly describes the points of difference relative to the post-processing device 9 of FIG. 14.

The post-processing device 9A control unit includes a post-processing control unit 90, channel switching members 91 and 96, a de-curling mechanism 92, and a humidifier 97. Also, in the post-processing device 9A, the recording sheet that has been transported to a de-curling transport channel 94 after thermal fixing is guided to a transport channel by the channel switching member 96, the transport channel being one of a detour transport channel 98 heading to the humidifier 97 and a non-detour transport channel 99 heading directly to the de-curling mechanism 92.

Figure 19:
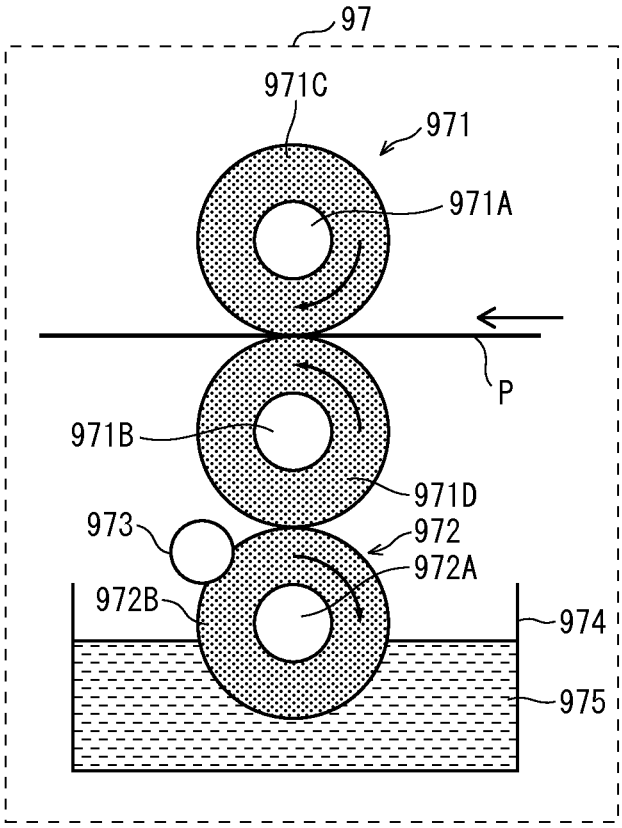
FIG. 19 depicts the configuration of a humidifier 97.

FIG. 19 illustrates a specific example of the humidifier 97. As illustrated, the humidifier 97 includes a pair of humidity rollers 971 applying moisture to the recording sheet, which is indicated by reference sign P and transported in the direction indicated by the arrow, a water supply roller 972 in contact with the pair of humidity rollers 971 and supplying water thereto, a control member 973 controlling the water supplied from the water supply roller 972 to the humidity rollers 971 by pressing into the outer circumferential surface of the water supply roller 972, and a water storage container 974. The water storage container 974 stores water 975.

Each roller is, for example, made from a shaft 971A, 971B, and 972A of metal, cured resin, or the like, and a respective porous layer 971C, 971D, and 972B made of porous urethane resin or similar formed around the circumference of each shaft 971A, 971B, and 972A.

The humidity rollers 971 and the water supply roller 972 are driven to rotate in the direction of the arrow by a non-diagrammed drive motor. The drive motor is controlled by the post-processing control unit 90.

Here, the humidifier 97 is not limited to the above-described configuration provided that humidity is evenly applied to the recording sheet. For example, the recording sheet may be humidified by spraying with water vapor.

Figure 20:
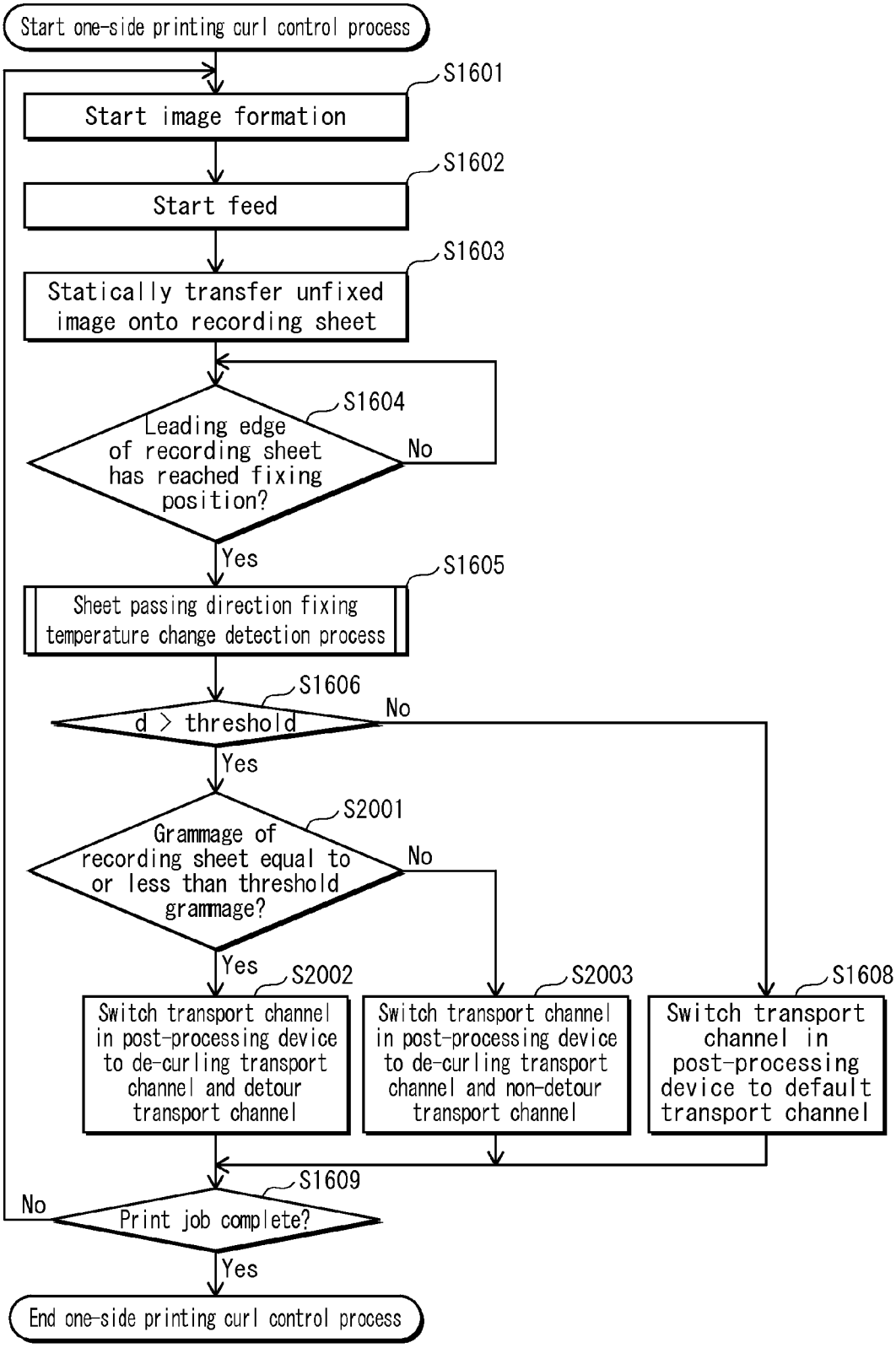
FIG. 20 is a flowchart indicating a modification of the operations of the one-side printing curl control process in FIG. 16.

FIG. 20 is a flowchart indicating a modification of the operations of the one-side printing curl control process indicated in FIG. 16. In FIG. 20, steps S1601 to S1605 representing processing identical to that of FIG. 16 uses identical step reference signs, and explanations thereof are omitted. The following mainly describes points of difference.

When the result of step S1606 is affirmative (YES in step S1606), the control unit 60 determines whether or not the grammage of the recording sheet is equal to or less than a grammage threshold (step S2001).

Then, when the result of step S2001 is affirmative (YES in step S2001), the control unit 60 controls the transport channel switching members 91 and 96 of the post-processing device 9A through the post-processing control unit 90 to switch the transport channel to the de-curling transport channel 94 and the detour transport channel 98, and thus transport the recording sheet, having been transported into the post-processing device 9A after thermal fixing, to the de-curling mechanism 92 via the humidifier 97, where the humidifier 97 humidifies the recording sheet and the de-curling mechanism then applies curl correction to the recording sheet (step S2002).

When the result of step S2001 is negative (NO in step S2001), the control unit 60 controls the transport channel switching members 91 and 96 of the post-processing device 9A through the post-processing control unit 90 to switch the transport channel to the de-curling transport channel 94 and the non-detour transport channel 99, thus transporting the recording sheet having been transported into the post-processing device 9A after thermal fixing directly to the de-curling mechanism 92 where the de-curling mechanism 92 applies curl correction to the recording sheet (step S2003).

As such, according to the present modification, when the grammage of the recording sheet is equal to or less than the grammage threshold, the humidifier 97 applies humidity to the recording sheet such that mechanical correction of the curl is applied after fiber resilience in the recording sheet has been lowered. Thus, insufficient curl correction is prevented from occurring, even in a thin recording sheet with low grammage.

(4) In the Embodiment, the heat roller 51 is assumed to have an even surface temperature, and the beginning of fixing position temperature acquisition coincides with the arrival of the leading edge of the recording sheet at the fixing position 53. However, given the offset in terms of distance between the fixing position 53 and the detection position at the outer circumferential surface of the heat roller 51 where the heat roller temperature sensor 500 performs detection, in order to reduce a temperature error caused by the offset, the beginning of the fixing position temperature acquisition may precede the arrival of the leading edge of the recording sheet at the fixing position 53 by time Δt required for the heat roller 51 to rotate by an amount corresponding to the distance.

Specifically, during the both-side printing transfer voltage control process of FIG. 8, the timing at which the sheet passing direction fixing temperature distribution sampling process begins in step S805 may be earlier than the arrival of the leading edge of the recording sheet at the fixing position 53 by Δt.

That is, surface temperatures of the heat roller 51 may be acquired at time points earlier by Δt than the time points at which the fixing position temperatures (i.e., surface temperatures of the heat roller 51) are acquired during the sheet passing direction fixing temperature distribution sampling process of FIG. 11, and the acquired surface temperatures of the heat roller 51 may be each considered to be the surface temperature of the heat roller 51 (i.e., the fixing position temperature) at a position where the recording sheet touches the outer circumferential surface of the heat roller 51 at the corresponding sampling sheet position when each sampling sheet position passes the fixing position 53.

Also, the present modification may also be applied to modifications (2) and (3) That is, during the one-side printing curl control process of FIGS. 16 and 21, the timing at which the sheet passing direction fixing temperature change detection process begins in step S1605 may be earlier than the arrival of the leading edge of the recording sheet at the fixing position 53 by Δt.

(5) In the Embodiment, the image forming device is an image forming device that performs a secondary transfer of the unfixed image from the intermediate transfer belt to the recording sheet after performing the primary transfer of the unfixed image onto the intermediate transfer belt. However, image forming devices to which the Embodiment is applicable are, of course, not limited to image forming devices performing the secondary transfer. For example, the Embodiment may also be applied to an image forming device performing a direct transfer of the unfixed image from the photosensitive drum to the recording sheet.

(6) The change in fixing position temperature along the sheet passing direction during thermal fixing is not limited to occurring when temperature increase (step S703) and temperature decrease (step S707) are performed in the inter-page fixing temperature adjustment process of FIG. 7. For example, when performing thermal fixing of an initial page in an image formation process commenced after power ON, after a stand-by state, or the like, the thermal fixing of the initial page begins immediately after the surface temperature of the heat roller 51 is increased to the target temperature. As such, in such cases, the surface temperature of the heat roller 51 after the increase is not stable, and fluctuation in the surface temperature of the heat roller 51 during the thermal fixing of the initial page is greater than that during the thermal fixing of the second and subsequent pages. Thus, the fixing position temperature is prone to fluctuations.

Accordingly, the both-side printing transfer voltage control process and the one-side printing curl control process of the Embodiment are also applicable to changes in fixing position temperature occurring in cases such as those described above.

(7) In the Embodiment, the applied transfer voltages at the sampling sheet positions are calculated using the transfer voltage formula. However, rather than using the transfer voltage formula, a table indicating a relationship between fixing position temperatures and applied transfer voltages may be created in advance (e.g., indicating the relationship between fixing position temperatures and applied transfer voltages at increments of 0.1° C. from the economy temperature to the upper limit temperature) and stored in the parameter storage unit 607. The table may then be used to determine the applied transfer voltage at each sampling sheet position.

CONCLUSION

The image forming device pertaining to the aspect of the present disclosure described above is an image forming device capable of performing both-side printing with respect to a recording sheet, the image forming device statically transferring, by application of a transfer voltage, an unfixed image formed on an image carrier to the recording sheet when passing through a transfer position, and then thermally fixing the unfixed image onto the recording sheet when the recording sheet passes through a fixing position where a heating rotating body is disposed, the image forming device including: a water content index acquisition unit configured to acquire an index value of a water content at each of a plurality of sheet-passing-direction positions of the recording sheet having undergone thermal fixing of a first unfixed image statically transferred onto a first side thereof; and a transfer control unit configured to control, for each of the positions of the recording sheet, a transfer voltage applied for statically transferring a second unfixed image onto a second side of the recording sheet, so that the lower the water content indexed by the index value of the position, the greater an absolute value of the transfer voltage.

In the image forming device, the water content index acquisition unit may acquire the index value at each of the positions of the recording sheet by acquiring a temperature of the heating rotating body when the position of the recording sheet passes through the fixing position.

In the image forming device, a temperature applied while thermally fixing an unfixed image having been statically transferred onto the recording sheet may be controlled to change from a first temperature to a second temperature that differs from the first temperature.

In the image forming device, for each page to be printed, a target temperature at which a temperature of the heating rotating body is to be maintained while performing thermal fixing for the page may be determined according to image information for the page.

According to the above-described configuration, after the recording sheet has undergone thermal fixing of a first unfixed image statically transferred onto a first side thereof during both-side printing, the transfer voltage applied at each of the position of the recording sheet for statically transferring the second unfixed image onto the second side of the recording sheet is controlled so that the lower the water content indexed by the index value of the position, the greater the absolute value of the transfer voltage. As such, despite variations in water content within the recording sheet during both-side printing, the effect of fluctuations in electrical resistance caused by these variations is canceled out, thus enabling the static transfer of the second unfixed image onto the second side to be performed without distortion. As a result, degradation in image quality on the second side is prevented.

The image forming device may further include: a calculation unit configured to calculate, in one-side printing, an amount indicating a change in the water content in the recording sheet in the sheet passing direction based on the index value acquired at each of the positions by the water content index acquisition unit; a de-curling unit correcting a curl of the recording sheet; and a curl control unit causing the de-curling unit to correct the curl of the recording sheet when the amount exceeds a threshold.

Further, the image forming device pertaining to the aspect of the present disclosure described above may be an image forming device statically transferring, by application of a transfer voltage, an unfixed image formed on an image carrier to a recording sheet passing through a transfer position, and then thermally fixing the unfixed image onto the recording sheet when the recording sheet passes through a fixing position where a heating rotating body is disposed, the image forming device including: a water content index acquisition unit configured to acquire an index value of a water content at each of a plurality of sheet-passing-direction positions of the recording sheet having undergone thermal fixing of the unfixed image statically transferred onto the recording sheet; a calculation unit configured to calculate an amount indicating a change in the water content in the recording sheet in the sheet passing direction based on the index value acquired at each of the positions by the water content index acquisition unit; a de-curling unit correcting a curl of the recording sheet; and a curl control unit causing the de-curling unit to correct the curl of the recording sheet when the amount exceeds a threshold.

Accordingly, when the variation in water content in the sheet passing direction of the recording sheet after thermal fixing exceeds a threshold, and there is a risk that the recording sheet may experience curling, the curling caused by the variation in water content during thermal fixing is prevented.

In the image forming device, the curl control unit may control, in accordance with the amount, a degree to which the de-curling unit corrects the curl.

As a result, the degree to which the de-curling unit corrects the curl is adjusted in accordance with the change in water content in the recording sheet in the sheet passing direction, enabling optimization of the curl correction as neither too weak nor too strong.

The image forming device may further include a humidifier unit configured to humidify the recording sheet, and in the image forming device, when the amount exceeds the threshold and a grammage of the recording sheet is no greater than a predetermined lower limit of the grammage, the curl control unit may cause the humidifier unit to humidify the recording sheet and then causes the de-curling unit to correct the curl of the recording sheet.

As such, when the grammage of the recording sheet is equal to or less than a lower threshold and mechanical correction is insufficient to correct the curling, then the recording sheet is humidified after fiber resilience has been lowered in the recording sheet. Thus, insufficient curl correction is prevented from occurring, even in a thin recording sheet with low grammage.

Although the present disclosure has been fully described by way of examples with reference to the accompanying drawings, it is to be noted that various changes and modifications will be apparent to those skilled in the art. Therefore, unless such changes and modifications depart from the scope of the present disclosure, they should be construed as being included therein.

What is claimed is:

1. An image forming device capable of performing both-side printing with respect to a recording sheet, the image forming device statically transferring, by application of a transfer voltage, an unfixed image formed on an image carrier to the recording sheet when passing through a transfer position, and then thermally fixing the unfixed image onto the recording sheet when the recording sheet passes through a fixing position where a heating rotating body is disposed, the image forming device comprising:

a water content index acquisition unit configured to acquire an index value of a water content at each of a plurality of sheet-passing-direction positions of the recording sheet having undergone thermal fixing of a first unfixed image statically transferred onto a first side thereof; and a transfer control unit configured to control, for each of the positions of the recording sheet, a transfer voltage applied for statically transferring a second unfixed image onto a second side of the recording sheet, so that the lower the water content indexed by the index value of the position, the greater an absolute value of the transfer voltage.

2. The image forming device of claim 1, wherein the water content index acquisition unit acquires the index value at each of the positions of the recording sheet by acquiring a temperature of the heating rotating body when the position of the recording sheet passes through the fixing position.

3. The image forming device of claim 1, further comprising:

a calculation unit configured to calculate, in one-side printing, an amount indicating a change in the water content in the recording sheet in the sheet passing direction based on the index value acquired at each of the positions by the water content index acquisition unit;

a de-curling unit correcting a curl of the recording sheet; and a curl control unit causing the de-curling unit to correct the curl of the recording sheet when the amount exceeds a threshold.

4. The image forming device of claim 3, wherein the curl control unit controls, in accordance with the amount, a degree to which the de-curling unit corrects the curl.

5. The image forming device of claim 3, further comprising a humidifier unit configured to humidify the recording sheet, wherein when the amount exceeds the threshold and a grammage of the recording sheet is no greater than a predetermined lower limit of the grammage, the curl control unit causes the humidifier unit to humidify the recording sheet and then causes the de-curling unit to correct the curl of the recording sheet.

6. The image forming device of claim 1, wherein a temperature applied while thermally fixing an unfixed image having been statically transferred onto the recording sheet is controlled to change from a first temperature to a second temperature that differs from the first temperature.

7. The image forming device of claim 1, wherein for each page to be printed, a target temperature at which a temperature of the heating rotating body is to be maintained while performing thermal fixing for the page is determined according to image information for the page.

8. An image forming device statically transferring, by application of a transfer voltage, an unfixed image formed on an image carrier to a recording sheet passing through a transfer position, and then thermally fixing the unfixed image onto the recording sheet when the recording sheet passes through a fixing position where a heating rotating body is disposed, the image forming device comprising:

a water content index acquisition unit configured to acquire an index value of a water content at each of a plurality of sheet-passing-direction positions of the recording sheet having undergone thermal fixing of the unfixed image statically transferred onto the recording sheet;

a calculation unit configured to calculate an amount indicating a change in the water content in the recording sheet in the sheet passing direction based on the index value acquired at each of the positions by the water content index acquisition unit;

a de-curling unit correcting a curl of the recording sheet; and a curl control unit causing the de-curling unit to correct the curl of the recording sheet when the amount exceeds a threshold.

9. The image forming device of claim 8, wherein the curl control unit controls, in accordance with the amount, a degree to which the de-curling unit corrects the curl.

10. The image forming device of claim 8, further comprising a humidifier unit configured to humidify the recording sheet, wherein when the amount exceeds the threshold and a grammage of the recording sheet is no greater than a predetermined lower limit of the grammage, the curl control unit causes the humidifier unit to humidify the recording sheet and then causes the de-curling unit to correct the curl of the recording sheet.

* * * * *